US012734393B2

(12) United States Patent
Li

(10) Patent No.: US 12,734,393 B2
(45) Date of Patent: Sep. 15, 2026

(54) RESISTANCE TRAINING SYSTEM

(71) Applicant: Dongguan Yiketang Management Co., ltd, Dongguan City (CN)

(72) Inventor: Ping Li, Dongguan City (CN)

(73) Assignee: Dongguan Yiketang Management Co., ltd, Dongguan City (CN)

( * ) Notice: Subject to any disclaimer, the term of this patent is extended or adjusted under 35 U.S.C. 154(b) by 158 days.

(21) Appl. No.: 18/657,690

(22) Filed: May 7, 2024

(65) Prior Publication Data

US 2024/0382797 A1 Nov. 21, 2024

(30) Foreign Application Priority Data

May 16, 2023 (CN) ..... 202310552815.X

(51) Int. Cl.
*A63B 21/00* (2006.01)
*A63B 21/005* (2006.01)
*A63B 24/00* (2006.01)

(52) U.S. Cl.
CPC ..... *A63B 21/154* (2013.01); *A63B 21/0058* (2013.01); *A63B 21/153* (2013.01); *A63B 24/0062* (2013.01); *A63B 2209/08* (2013.01); *A63B 2220/833* (2013.01)

(58) Field of Classification Search
CPC ..... A63B 21/0058–0059; A63B 21/153–156; A63B 21/4043
See application file for complete search history.

(56) References Cited

U.S. PATENT DOCUMENTS

2022/0184452 A1* 6/2022 Valente ..... A63B 21/0058
2023/0103725 A1* 4/2023 Neuhaus ..... A63B 21/156 482/5

FOREIGN PATENT DOCUMENTS

GB 2612311 A * 5/2023 ..... A63B 21/4049

* cited by examiner

*Primary Examiner* — Jennifer Robertson
(74) *Attorney, Agent, or Firm* — Che-Yang Chen

(57) ABSTRACT

A resistance training system, comprising a main body (10), a resistance motor (20), and a traction rope (30), wherein the traction rope (30) has a winding end (31) and a connecting end (32), wherein the winding end (31) is wound around the rotating output shaft of the resistance motor (20), and the connecting end (32) is actively connected to a converter (100), wherein the converter and a puller (40) correspond to each other. The resistance motor (20) is able to generate a tension force (F), wherein the tension force (F) is transmitted through the traction rope (30) and the converter to the puller (40). The converter (100) has a direct tension transmission manner and a multileveled tension transmission manner, and the converter (100) is able to switch between the direct tension transmission manner and the multileveled tension transmission manner.

15 Claims, 25 Drawing Sheets

RESISTANCE TRAINING SYSTEM

BACKGROUND OF THE PRESENT INVENTION

Field of Invention

The present invention relates to a resistance training system, and more particularly to a resistance training system having a direct tension transmission manner and a multi-leveled tension transmission manner, and is able to freely switch between the two operating manners thereof.

Description of Related Arts

As is known to everyone, exercising is the best way to maintain physical health. Exercising, in particular to regular muscle training, is the optimal method for maintaining health, shaping the body, and promoting health care. A variety of fitness equipment has been commonly used by people to facilitate muscle training.

As shown in FIG. 1, currently, resistance training machines are the most widely used equipment among all fitness equipment. The main working principle of a resistance training machine comprises a traction rope (1) provided with a puller device (2) at one end, wherein the puller device (2) can be a handle, a pull rod, a push rod, among others. Correspondingly, the other end of the traction rope (1) is provided with a resistance device (3), wherein the resistance device (3) can be a weight plate, a resistance motor, among others. While in use, the resistance device (3) generates a resistance force, wherein the resistance force is transmitted through the traction rope (1) to the position of the puller device (2), wherein the puller device (2) acts on the human body to achieve the goal of muscle training.

As shown in FIG. 2, in order to change the direction of transmission of the resistance force for the convenience of users, in practice, a plurality of fixed pulleys is provided to achieve the purpose thereof. In practice, various household strength training machines utilizes this principle, such as leg presses, chest presses, among others.

Generally, resistance devices (3) are mostly weight plates in public fitness centers. However, in order to reduce the weight and minimize the coverage area, resistance devices (3) are mostly resistance motors for household training machines.

As shown in FIGS. 2 to 4, when the resistance device (3) is a resistance motor (31), there are usually two transmission manners of resistance force. As shown in FIG. 2, a fixed pulley transmission manner, wherein the main advantage of the transmission manner is the direct transmission of force, wherein the resistance force is able to be directly transmitted through the traction rope (1) to the puller device (2), and the main disadvantage is that the maximum output of the resistance motor (31) is limited, thus the transmission manner can only satisfy muscle training of low force, limiting the scope of application. For example, when the resistance motor (31) only has a maximum output resistance force of 60 kilograms, under such condition, the resistance motor (31) can only satisfy people with training requirements of below 60 kilograms. In order to satisfy people with heavy training requirements, the maximum output of the resistance motor (31) needs to be multiplied. However, this implementation will not only significantly increase the production cost of the machine, but will also pose some safety risks.

As shown in FIGS. 3 to 4, when the resistance motor (31) has the maximum rated output, in order to increase the training weight, the movable pulley transmission manner is utilized.

Wherein the main advantage of the transmission manner is that by utilizing the mechanical principles of movable pulleys, the training weight is able to be multiplied under the maximum rated output of the resistance motor (31).

However, the main disadvantage is that the transmission manner is highly prone to "rope jamming", which further resulting in accidents.

The cause of accidents is described as following, there are two types of training manners when people are engaged in strength training, wherein the first manner involves training with heavy weights at a slow pace, while the second manner involves training with light weights at a fast pace.

As shown in FIG. 3, for the case of the first manner, the aforementioned movable pulley transmission manner can generally satisfy the training requirements. Under such condition, the rated output of the resistance motor (31) is greater, thus the generated resistance force is also greater. With the large resistance force acting on the human body, at this moment, the human body can only fully endure the large resistance force by reducing the pace of exercise.

For example, if the resistance motor (31) generates an output resistance force of 60 kilograms, the resistance force at the position of the puller device (2) will reach 120 kilograms through the movable pulley (5). Under such loading condition, the human body can only overcome the resistance force by reducing the pace of exercise to complete the weight-bearing training.

The traction rope (1) is wound around the rotating output shaft of the resistance motor (31). Under the condition of the first manner, when the human body performs training, the resistance motor (31) rotates and slowly releases the traction rope (1). When the human body performs a recovery action, the resistance motor (31) rotates and slowly rewinds the traction rope (1).

Under the condition of the first manner, the resistance motor (31) operates at a lower rotational speed to match with the slow movements of the human body during training. The rotational speed of the resistance motor (31) is able to match the actions of releasing and retracting the traction rope (1).

As shown in FIG. 4, however, while under the condition of the second manner, the aforementioned movable pulley transmission manner is not able to satisfy the training requirements.

Under the condition of the second manner, the rated output of the resistance motor (31) is lower, thus the generated resistance force is also lower. Due to the lower resistance force, the pace of exercise of the human body has to be increased, thus the frequency of movement repetitions also has to be increased.

For example, if the resistance motor (31) generates an output resistance force of 1 kilogram, the resistance force at the position of the puller device (2) will be 2 kilograms through the movable pulley (5). Under such a light loading condition, the human body is able to easily overcome the resistance force to complete the training. Therefore, the pace of exercise of the human body has to be increased, thus the frequency of movement repetitions also has to be increased.

Under such condition, the resistance motor (31) needs to operate at twice the rotational speed as compared to the first manner in order to complete the action of rewinding the traction rope (1). However, in practice, the performance of the resistance motor (31) is often not able to meet the aforementioned requirement. Consequently, there will be situations where the resistance motor (31) is not able to retract the rope in a timely manner, and when such situation occurs, the traction rope (1) will inevitably become "slacken" or "tangled" at the position of the movable pulley (5), thus further resulting in accidents.

As described above, those are the main disadvantages of the currently available technology.

SUMMARY OF THE PRESENT INVENTION

The present invention provides a resistance training system, comprising a main body (10), a resistance motor (20), and a traction rope (30), wherein the traction rope (30) has a winding end (31) and a connecting end (32), wherein the winding end (31) is wound around the rotating output shaft of the resistance motor (20), and the connecting end (32) is actively connected to a converter (100), wherein the converter (100) and a puller (40) correspond to each other. The resistance motor (20) is able to generate a tension force (F), wherein the tension force (F) is transmitted through the traction rope (30) and the converter (100) to the puller (40).

The converter (100) has two usage manners, namely a direct tension transmission manner and a multileveled tension transmission manner. While operating under the direct tension transmission manner, the converter (100) is able to directly transmit the tension force (F) to the puller (40). While operating under the multileveled tension transmission manner, the converter (100) is able to transform the tension force (F) to a multileveled tension force (Fs), wherein the multileveled tension force (Fs) is subsequently transmitted to the puller (40). The converter (100) is able to switch between the direct tension transmission manner and the multileveled tension transmission manner.

A resistance training system, comprising a main body (10), a resistance motor (20), and a traction rope (30), wherein the traction rope (30) has a winding end (31) and a connecting end (32), wherein the winding end (31) is wound around the rotating output shaft of the resistance motor (20), and the connecting end (32) is actively connected to a converter (100), wherein the converter (100) and a puller (40) correspond to each other. The resistance motor (20) is able to generate a tension force (F), wherein the tension force (F) is transmitted through the traction rope (30) and the converter (100) to the puller (40).

The converter (100) has two usage manners, namely a direct tension transmission manner and a doubled tension transmission manner. While operating under the direct transmission manner, the converter (100) is able to directly transmit the tension force (F) to the puller (40). While operating under the doubled tension transmission manner, the converter (100) is able to transform the tension force (F) to a doubled tension force (Fa), wherein the doubled tension force (Fa) is subsequently transmitted to the puller (40). The converter (100) is able to switch between the direct tension transmission manner and the doubled tension transmission manner.

The invention is advantageous in that the invention is provided with a converter (100), wherein the converter (100) has a direct tension transmission manner and a multileveled tension transmission manner. While operating under the direct tension transmission manner, the converter (100) is able to directly transmit the tension force (F) generated by the resistance motor (20) to the puller (40). While operating under the multileveled tension transmission manner, the converter is able to transform the tension force generated by the resistance motor to a multileveled tension force (Fs), wherein the multileveled tension force (Fs) is subsequently transmitted to the puller (40).

In addition, the converter (100) is able to switch between the direct tension transmission manner and the multileveled tension transmission manner.

When the present invention is operating under the direct tension transmission manner, the requirements of training with light weights at a fast pace can be satisfied, and when the present invention is operating under the direct tension transmission manner, the requirements of training with heavy weights at a slow pace can be satisfied.

DETAILED DESCRIPTION OF THE PREFERRED EMBODIMENT

Figure 1:
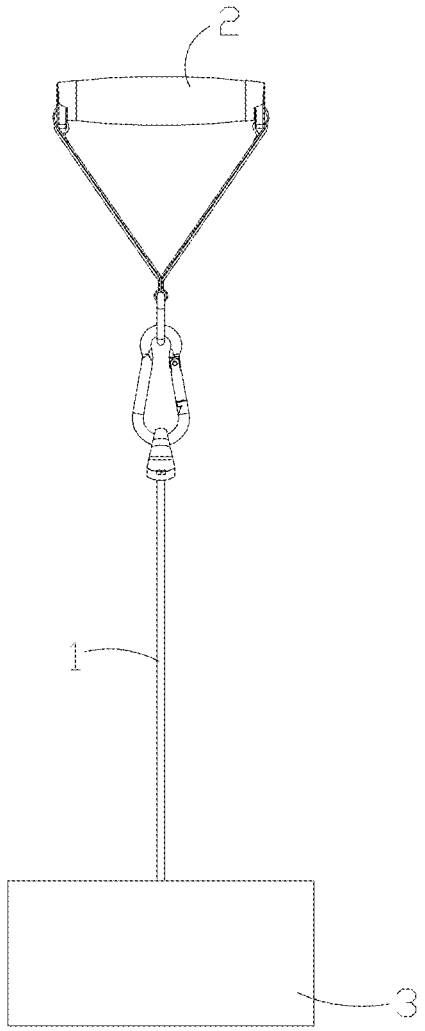
FIG. 1 is a schematic view of a resistance training machine of the prior art.
Figure 2:
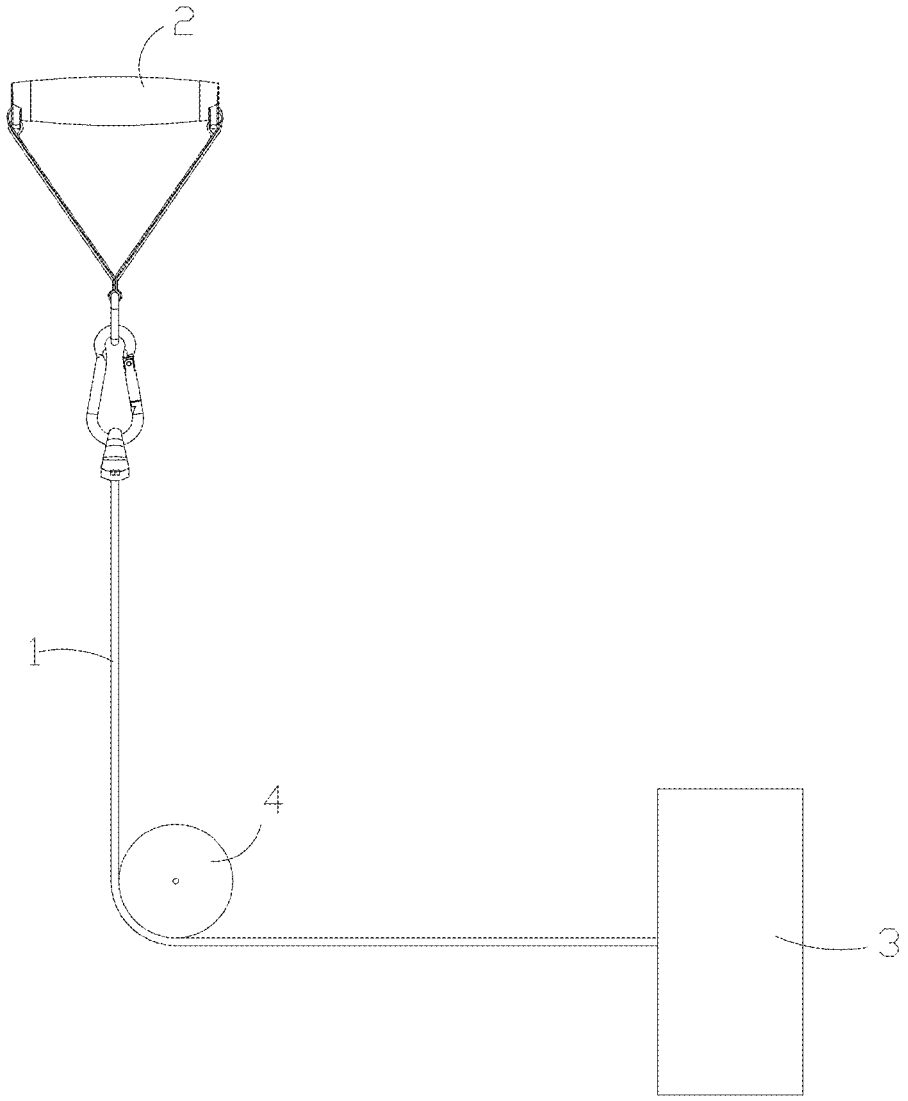
FIG. 2 is a schematic view of a resistance training machine with an additional fixed pulley of the prior art.
Figure 3:
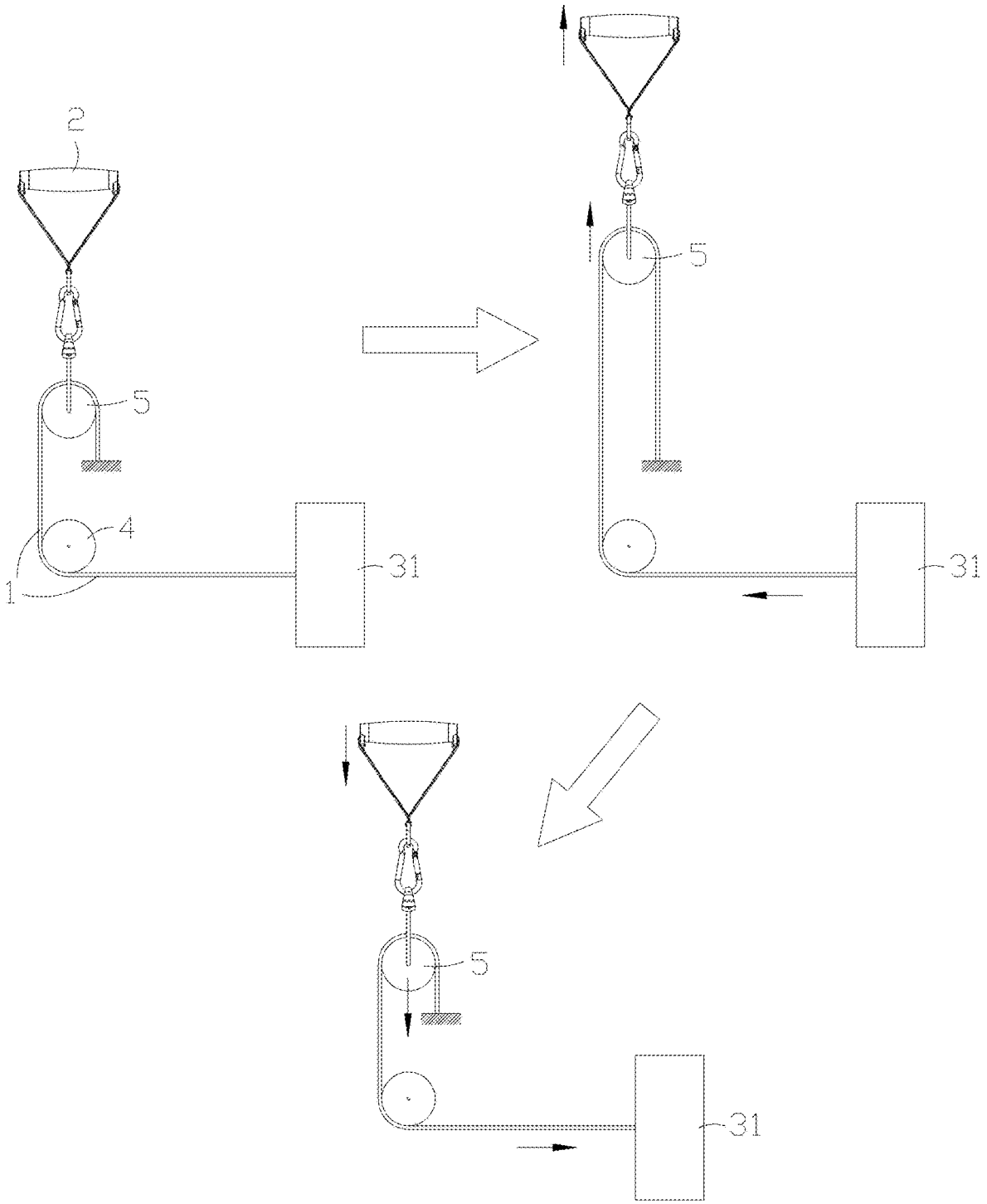
FIG. 3 illustrates an action of training with heavy weights at a slow pace of a resistance training machine of the prior art.
Figure 4:
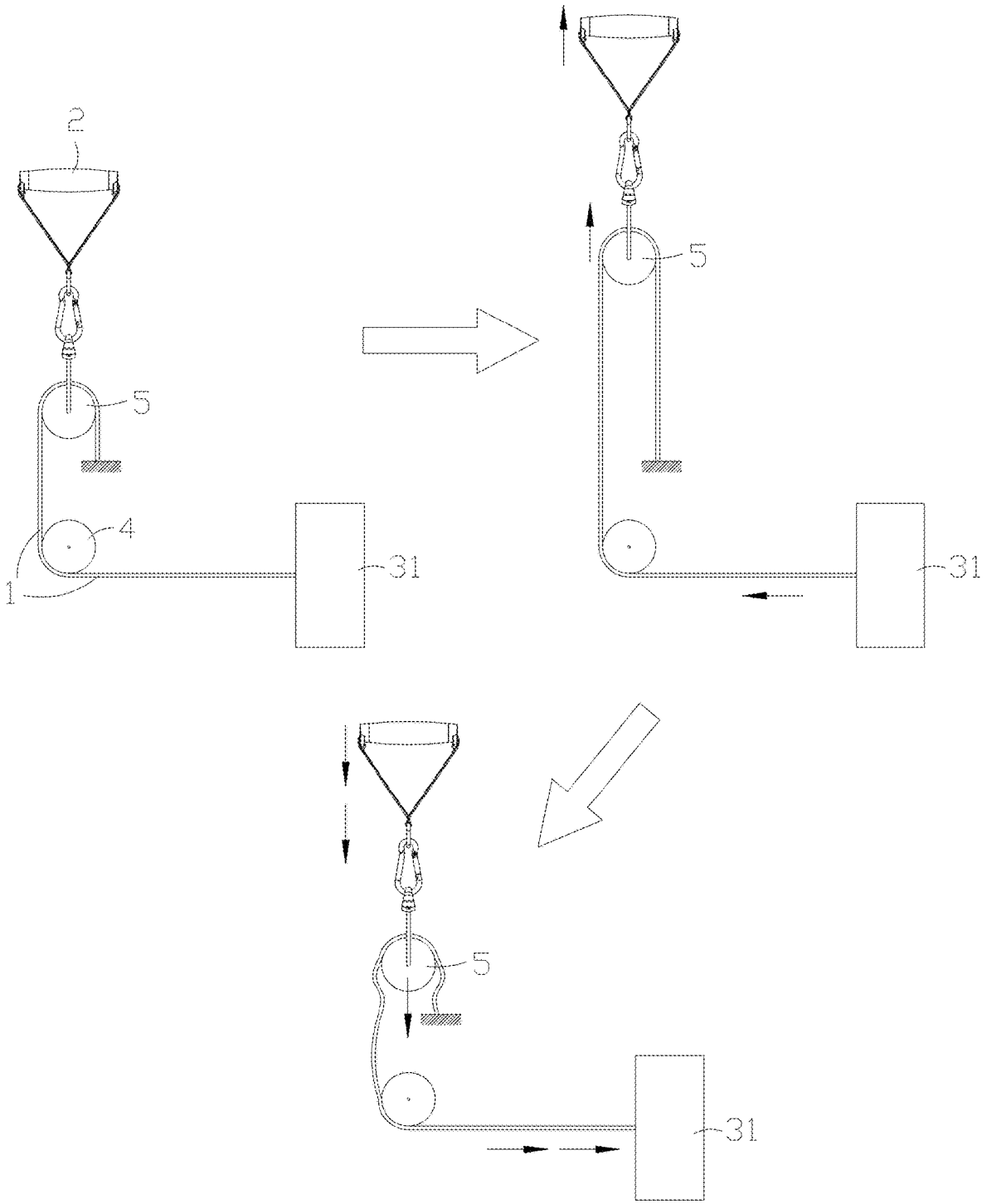
FIG. 4 illustrates an action of training with light weights at a fast face of a resistance training machine of the prior art.
Figure 5:
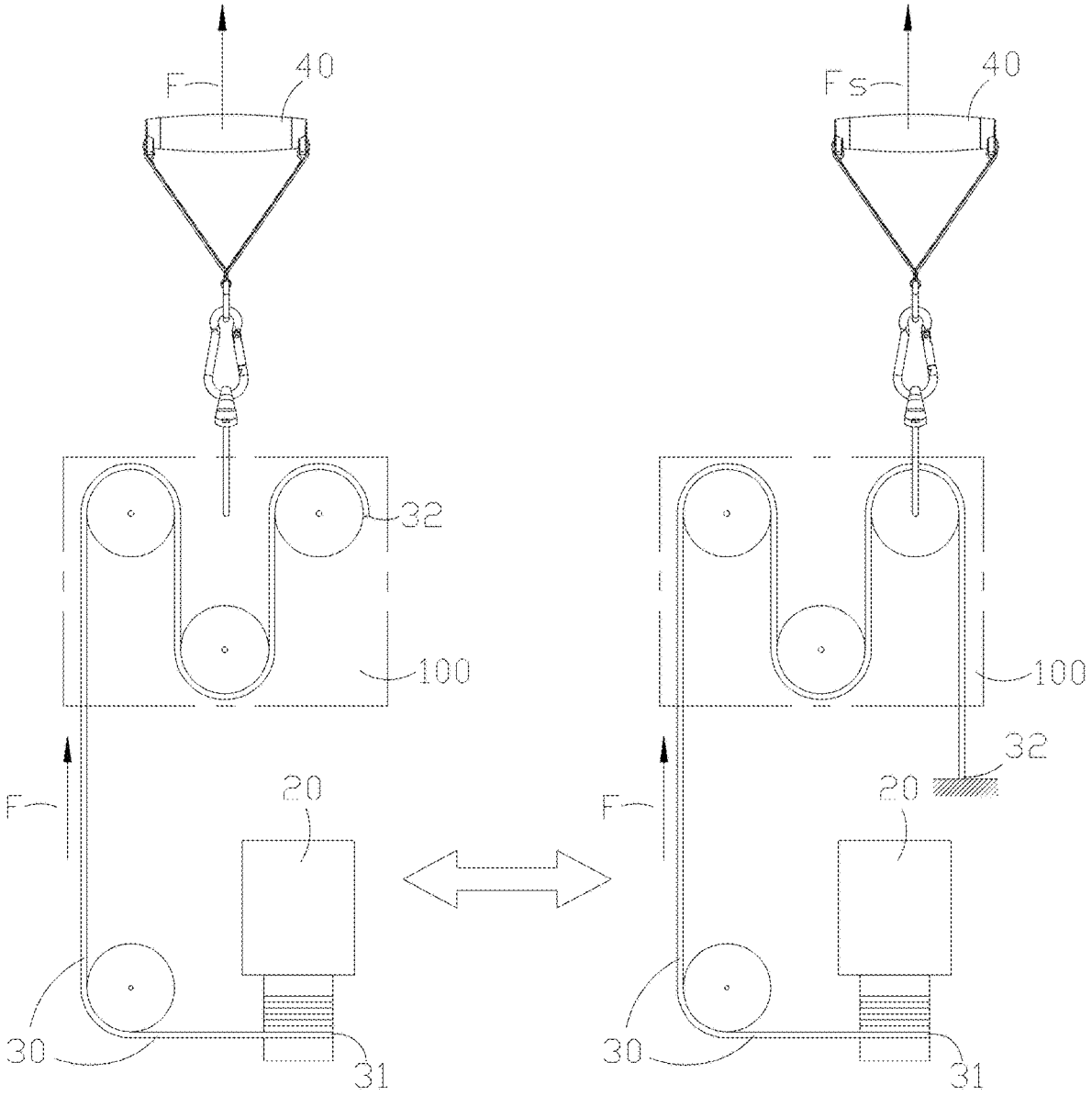
FIG. 5 is a schematic diagram of a direct tension transmission manner and a multileveled tension transmission manner of the present invention.
Figure 6:
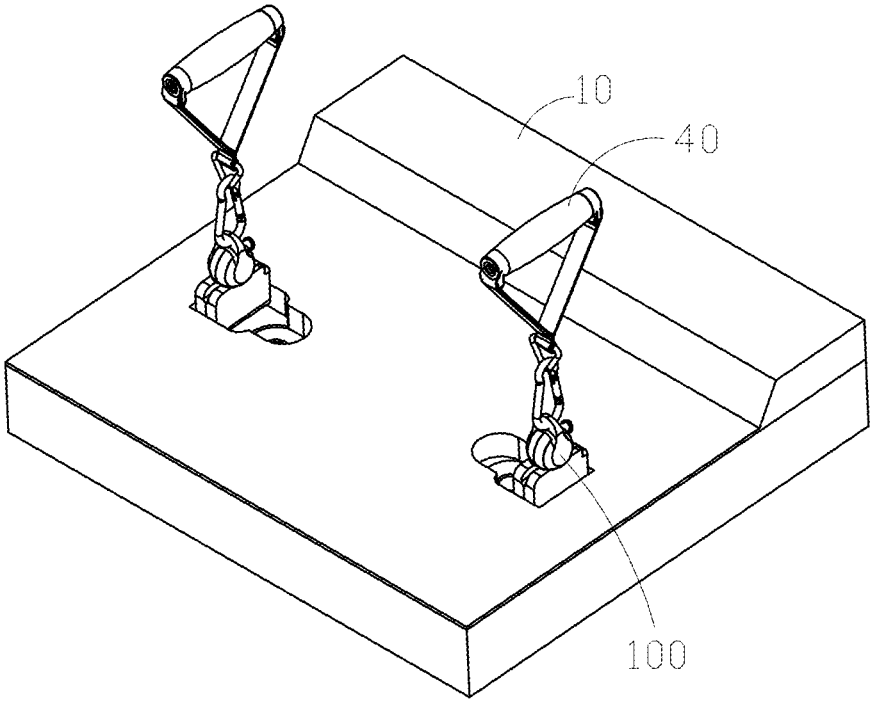
FIG. 6 is a three-dimensional perspective view of the present invention.
Figure 7:
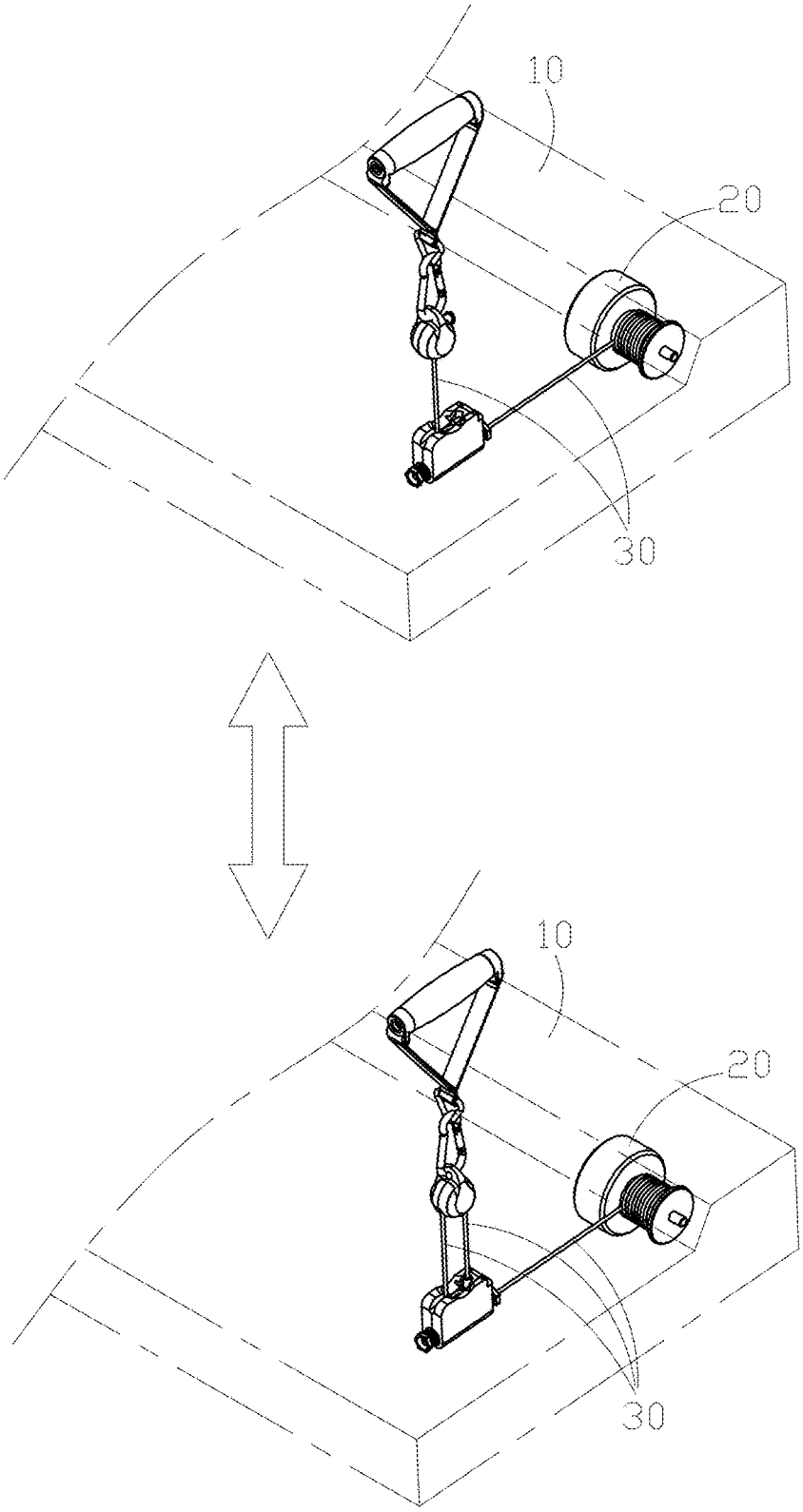
FIG. 7 is a perspective view of an operation of the present invention.

As shown in FIGS. 5 to 9, and more particularly as shown in FIG. 5, a resistance training system, comprising a main body (10), a resistance motor (20), and a traction rope (30), wherein the resistance motor (20) is fixedly provided in the main body (10).

The traction rope (30) has a winding end (31) and a connecting end (32), wherein the winding end (31) is wound around the rotating output shaft of the resistance motor (20), and the connecting end (32) is provided on the external of the main body (10), wherein the connecting end (32) is actively connected to a converter (100).

Wherein the converter (100) and a puller (40) are interconnected to each other.

In one embodiment, the puller (40) can either be a tension handle, a weight bar, or any other tension device.

While in use, firstly, the resistance motor (20) operates and generates a tension force (F), wherein the tension force (F) is subsequently transmitted through the traction rope (30) to a converter (100), and lastly, the converter (100) transmits the tension force (F) to the puller (40). At this moment, the puller (40) applies the tension force (F) on the human body, thus applying weight on the human body to achieve the purpose of muscle training.

In one embodiment, when the puller (40) is a tension handle, users are able to manually pull the tension handle to achieve the purpose of training upper body muscles, such as training biceps, pectoralis major, latissimus dorsi, among others.

When the puller (40) is a weight bar, users are able to shoulder the weight bar to achieve the purpose of training lower body muscles, such as training leg muscles, gluteal muscles, among others.

The resistance motor (20) is able to generate a tension force (F), wherein the tension force (F) is transmitted through the traction rope (30) and the converter (100) to the puller (40).

The converter (100) has a direct tension transmission manner and a multileveled tension transmission manner.

While operating under the direct tension transmission manner, the converter (100) is able to directly transfer the tension force (F) to the puller (40).

While operating under the multileveled tension transmission manner, the converter (100) is able to convert the tension force (F) to a multileveled tension force (Fs), wherein the multileveled tension force (Fs) is subsequently transmitted to the puller (40).

The converter (100) is able to switch between the direct tension transmission manner and the multileveled tension transmission manner.

For a better understanding, an example is provided as below. For instance, when the resistance motor (20) generates the tension force (F) of 60 kilograms, while operating under the direct tension transmission manner, the converter (100) is able to directly transmit the tension force of 60 kilograms to the puller (40). Under such condition, the converter (100) can be a simple hook connector.

While operating under the multileveled tension transmission manner, the converter (100) is able to convert the tension force (F) of 60 kilograms to the multileveled tension force (Fs) of either two or three times of the tension force (F), wherein the multileveled tension force (Fs) is subsequently transmitted to the puller (40), and at this moment, the tension force at the puller (40) is either 120 kilograms or 180 kilograms. Under such condition, the converter (100) can be a movable pulley or a pulley system.

In practical application, since the product of the present invention is used for training muscles of the human body, and the ability of the human body to bear the weight is limited, in practice, providing double of the tension force under the operation of the multileveled tension transmission manner is sufficient to completely satisfy the requirement of the limit of the bearable weight of the human body. Furthermore, while providing double of the tension force, the structural design of the product is much simpler, and the manufacturing cost is also correspondingly lower, which the embodiment is described as below.

As shown in FIGS. 6 to 9, a resistance training system, comprising a main body (10), a resistance motor (20), and a traction rope (30), wherein the resistance motor (20) is fixedly provided in the main body (10).

The traction rope (30) has a winding end (31) and a connecting end (32), wherein the winding end (31) is wound around the rotating output shaft of the resistance motor (20), and the connecting end (32) is provided on the external of the main body (10), wherein the connecting end (32) is actively connected to a converter (100).

Wherein the converter (100) and a puller (40) are interconnected to each other.

The resistance motor (20) is able to generate a tension force (F), wherein the tension force (F) is transmitted through the traction rope (30) and the converter (100) to the puller (40).

The converter (100) has a direct tension transmission manner and a doubled tension transmission manner.

Figure 8:
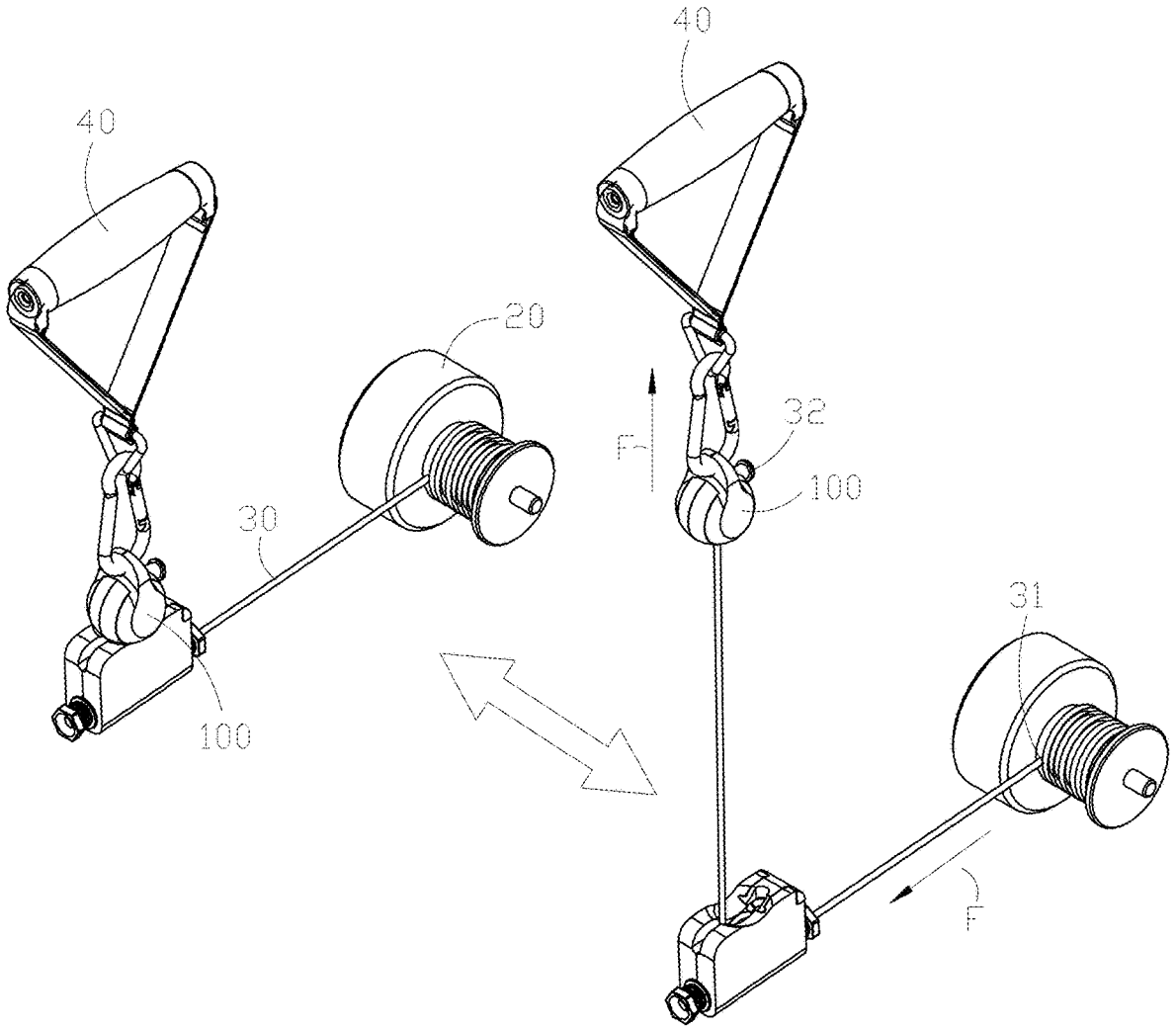
FIG. 8 is a perspective view of a converter during an operation of a direct tension transmission manner of the present invention.

As shown in FIG. 8, while operating under the direct tension transmission manner, the converter (100) is able to directly transmit the tension force (F) to the puller (40).

Figure 9:
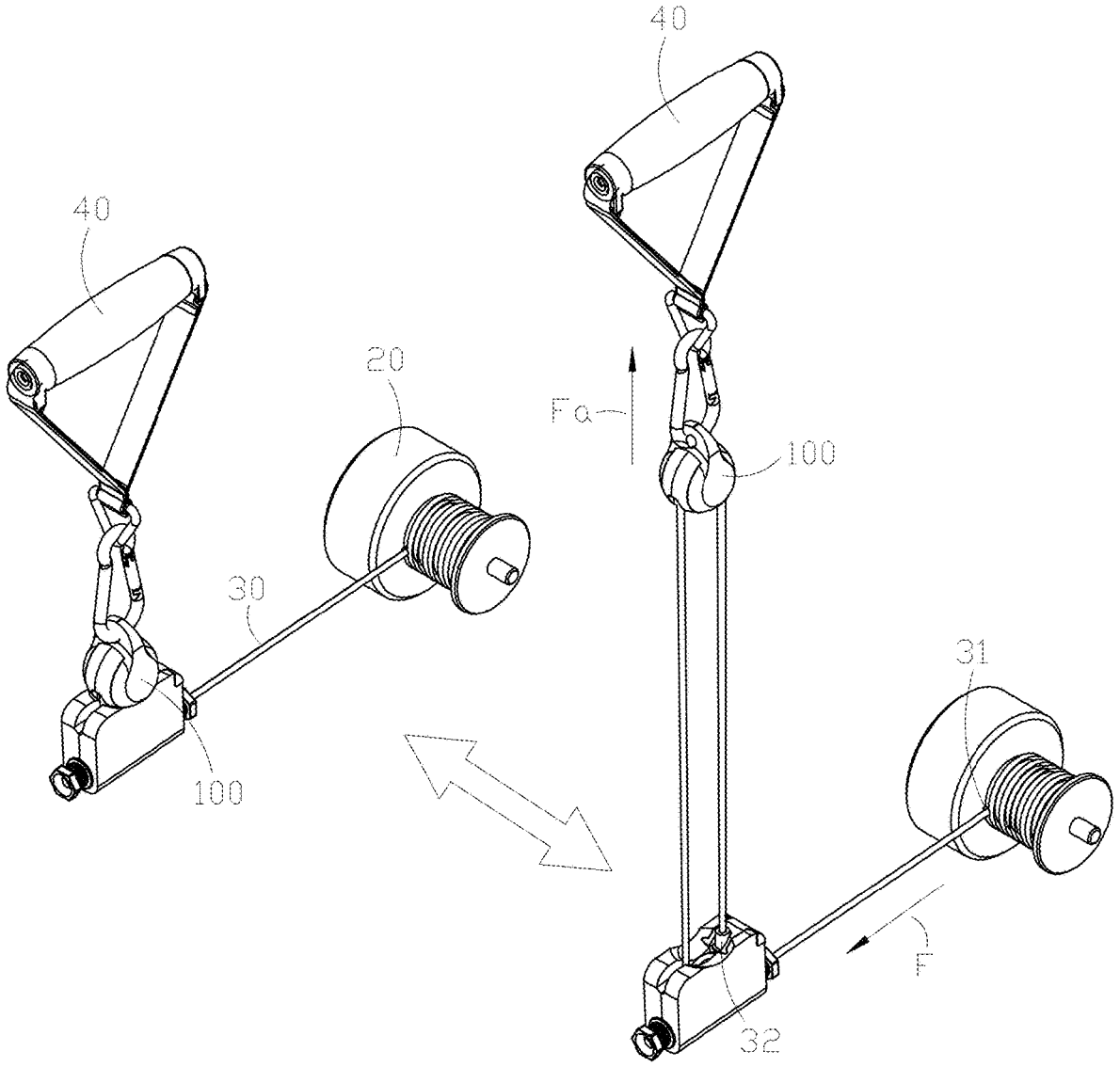
FIG. 9 is a perspective view of a converter during an operation of a doubled tension transmission manner of the present invention.

As shown in FIG. 9, while operating under the doubled tension transmission manner, the converter (100) is able to convert the tension force (F) to a doubled tension force (Fa), wherein the doubled tension force (Fa) is subsequently transmitted to the puller (40).

The converter (100) is able to switch between the direct tension transmission manner and the doubled tension transmission manner.

Since the product of the present invention is used for training muscles of the human body, and the ability of the human body to bear the weight is limited, in practice, the operation of the doubled tension transmission manner is sufficient to completely satisfy the requirement of the limit of bearable weight of the human body. Furthermore, the operation of the doubled tension transmission manner has a simpler structural design, thus the manufacturing cost is also correspondingly lower.

When the converter (100) has two operating manners of direct tension transmission and doubled tension transmission, there are several preferred embodiments in practice, which are described as below.

Figure 10:
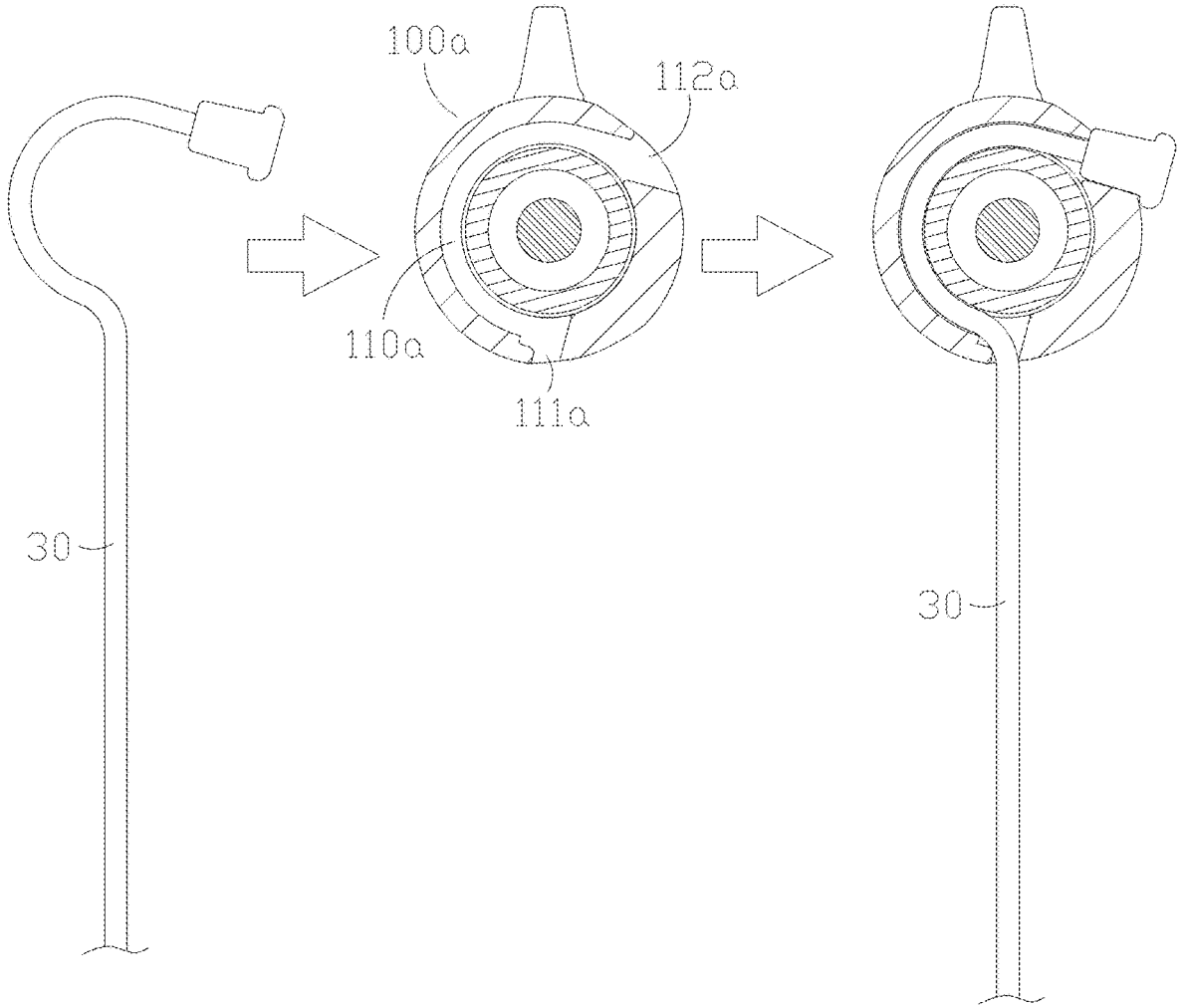
FIG. 10 is a sectional view of a converter of the first embodiment of the present invention.
Figure 11:
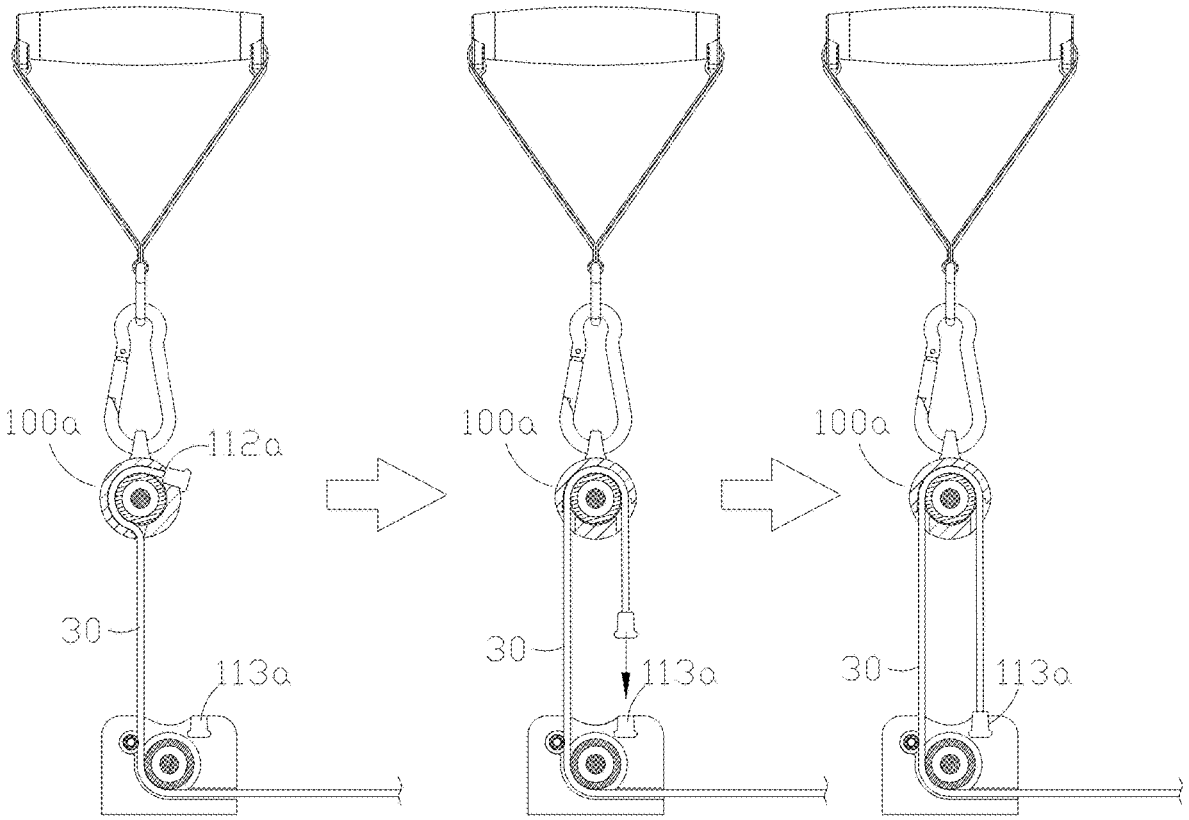
FIG. 11 is a perspective view of a converter switching between a direct tension transmission manner and a doubled tension transmission manner of the first embodiment of the present invention.

As shown in FIG. 10 to FIGS. 20, the first embodiment, more particularly as shown in FIGS. 10 to 11, the converter (100*a*) comprises a traction rope channel (110*a*), a free rope hole (111*a*), a fixed rope hole (112*a*), and a connecting end fixture (113*a*).

Wherein the free rope hole (111*a*) and the fixed rope hole (112*a*) are respectively positioned at both ends of the traction rope channel (110*a*).

The connecting end fixture (113*a*) can be set either on the main body (10) or on the external of the main body (10).

The traction rope (30) is simultaneously threaded through the traction rope channel (110*a*), the free rope hole (111*a*), and the fixed rope hole (112*a*).

In one embodiment, the traction rope channel (110*a*) can be either an enclosed channel or an opened channel.

Figure 12:
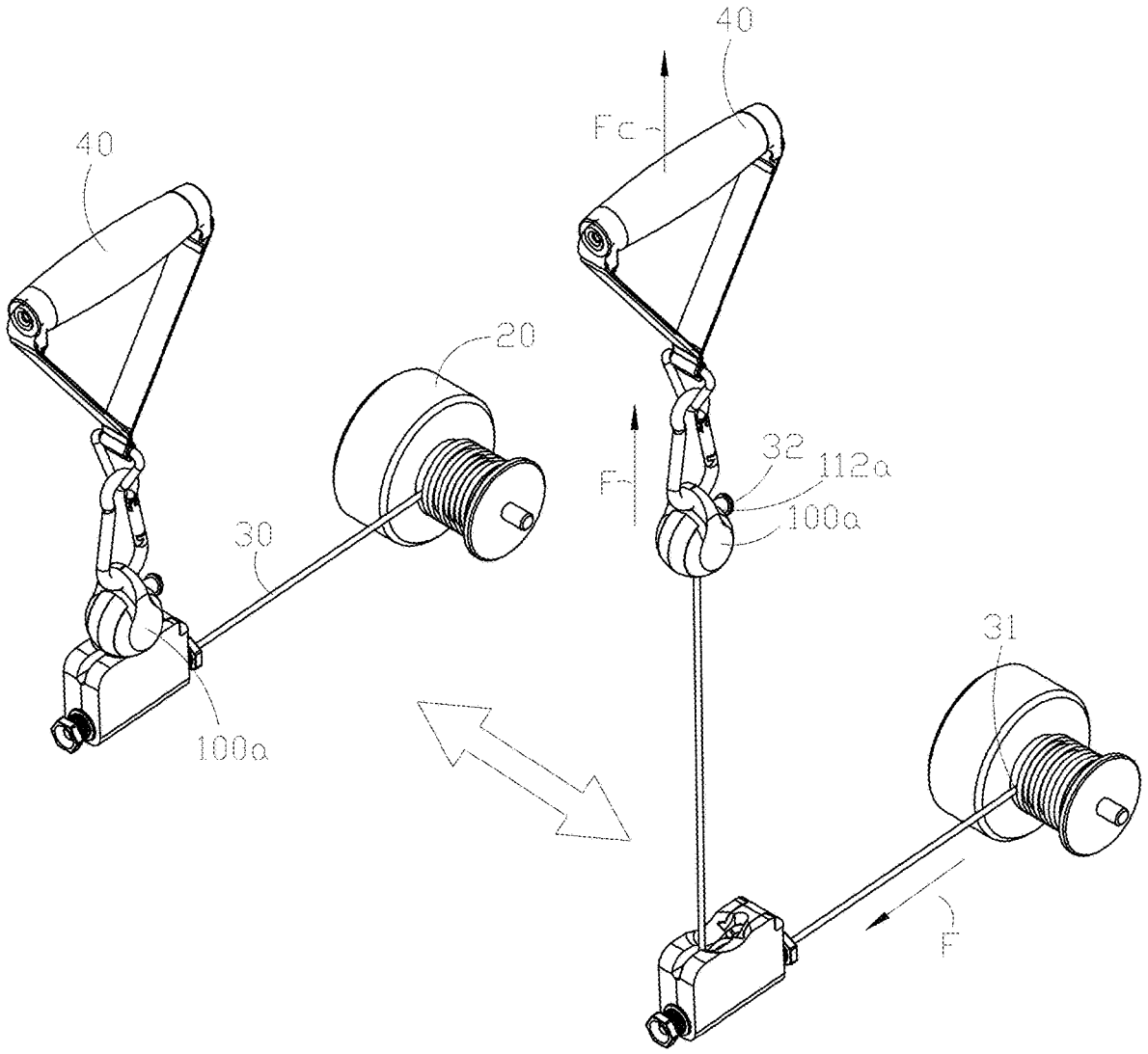
FIG. 12 is a perspective view of a converter operating under a direct tension transmission manner of the first embodiment of the present invention.

As shown in FIG. 12, while operating under the direct tension transmission manner, the puller (40) is connected to the converter (100*a*), and the connecting end (32) of the traction rope (30) is fixed at the position of the fixed rope hole (112*a*).

The tension force (F) generated by the resistance motor (20) is transmitted through the traction rope (30) and the converter (100*a*) to the puller (40).

At this moment, the training force (Fc) generated on the puller (40) is equal to the tension force (F) generated by the resistance motor (20), thus able to satisfy the requirements of the second manner of training with light weights at a fast pace as described in the background of the present invention.

Figure 13:
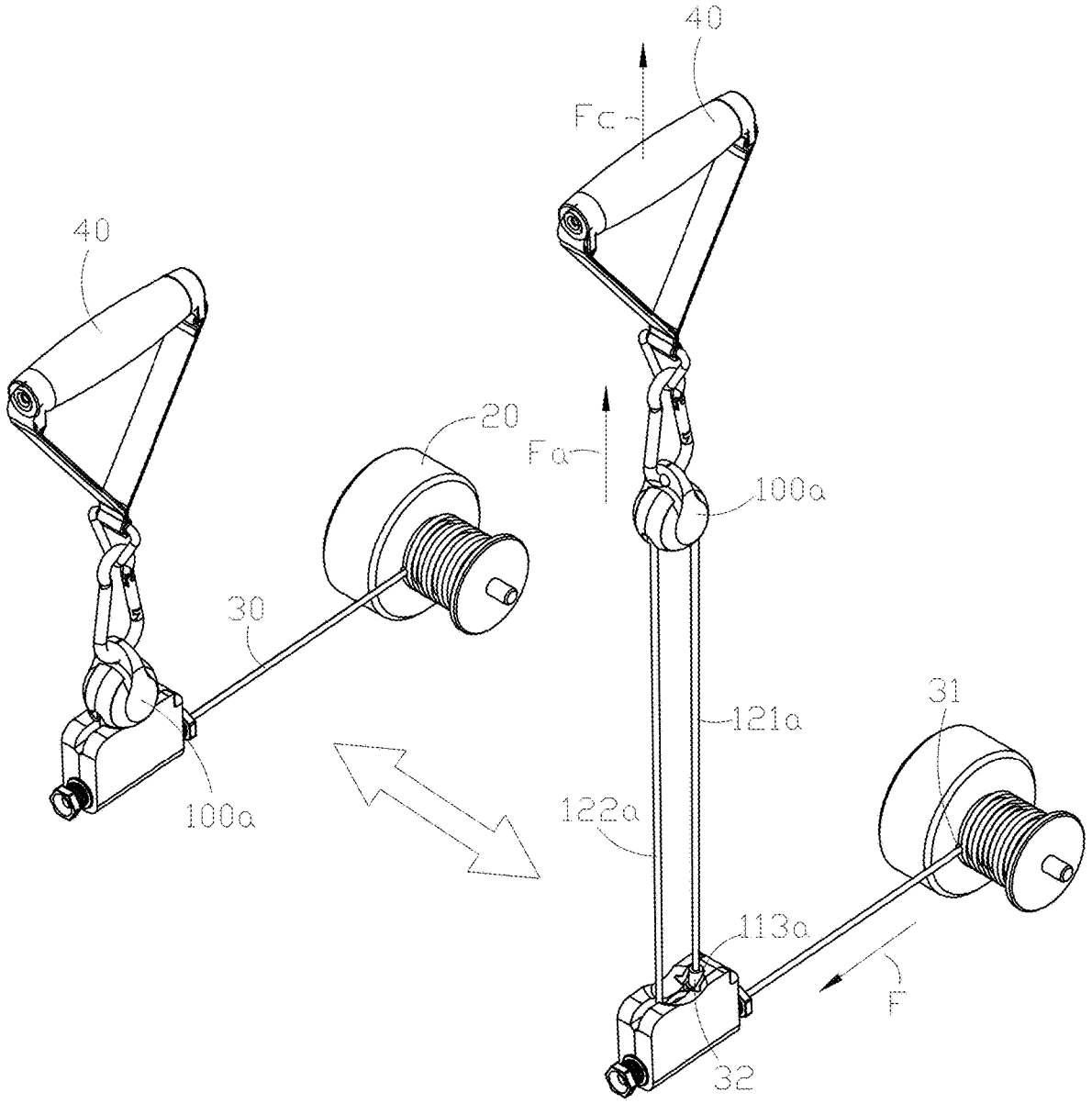
FIG. 13 is a perspective view of a converter operating under a doubled tension transmission manner of the first embodiment of the present invention.

As shown in FIG. 13, while operating under the doubled tension transmission manner, the puller (40) is connected to the converter (100*a*), and the connecting end (32) of the traction rope (30) is fixed to the connecting end fixture (113*a*).

The converter (100*a*) is positioned in between of the winding end (31) of the traction rope (30) and the connecting end (32) of the traction rope (30).

The traction rope (30) forms a primary tension portion (121*a*) in between of the fixed rope hole (112*a*) and the connecting end fixture (113*a*).

The traction rope (30) forms a secondary tension portion (122*a*) in between of the converter (100*a*) and the winding end (31).

The tension force (F) generated by the resistance motor (20) is transmitted to the traction rope (30), and the converter (100*a*) transforms the tension force (F) to the doubled tension force (Fa), wherein the doubled tension force (Fa) is transmitted through the converter (100*a*) to the puller (40).

At this moment, the training force (Fc) generated on the puller (40) is equal to the doubled tension force (Fa). The training force (Fc) generated on the puller (40) is two times of the tension force (F) generated by the resistance motor (20), thus able to satisfy the requirements of the first manner of training with heavy weights at a slow pace as described in the background of the present invention.

As shown in FIG. 11, by fixing the connecting end (32) at the position of the fixed rope hole (112*a*) or at the connecting end fixture (113*a*), the switching between the direct tension transmission manner and the doubled tension transmission manner can be achieved.

In other words, when the connecting end (32) is fixed at the position of the fixed rope hole (112*a*), the users are able to perform single-tensioned training of light weight and fast pace, and conversely, when the connecting end (32) is fixed in the connecting end fixture (113*a*), the users are able to perform double-tensioned training of heavy weight and slow pace, thus allowing the training force (Fc) to be doubled while maintaining the rated output of the resistance motor (20), which the switching method is also simple and reliable.

Figure 14:
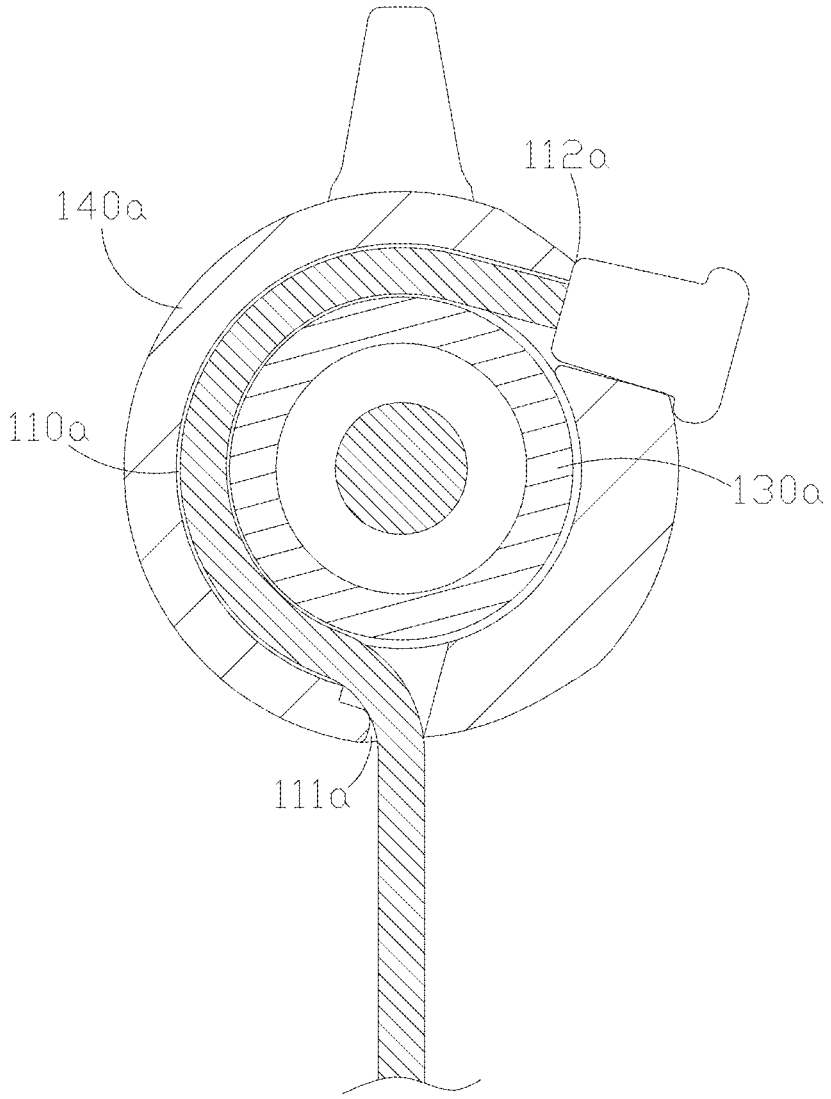
FIG. 14 is a perspective view of a traction rope channel, a free rope hole, and a fixed rope hole of a converter of the first embodiment of the present invention.

In one embodiment, as shown in FIG. 14, the converter (100*a*) comprises a wheel (130*a*) and a wheel housing (140*a*), wherein the wheel (130*a*) is rotatably set in the wheel housing (140*a*), and the traction rope channel (110*a*) is in between of the wheel (130*a*) and the wheel housing (140*a*). The free rope hole (111*a*) and the fixed rope hole (112*a*) is set on the wheel housing (140*a*), wherein the free rope hole (111*a*) and the fixed rope hole (112*a*) are respectively interconnected with the traction rope channel (110*a*).

In practice, the free rope hole (111*a*) is set at the bottom of the wheel housing (140*a*), and the fixed rope hole (112*a*) is set at one side of the wheel housing (140*a*) for the convenience of the threading of the traction rope (30) as well as the convenience of the switching of the operation manner.

In practice, the wheel (130*a*) is provided with a rope groove to facilitate the positioning of the traction rope (30).

Figure 15:
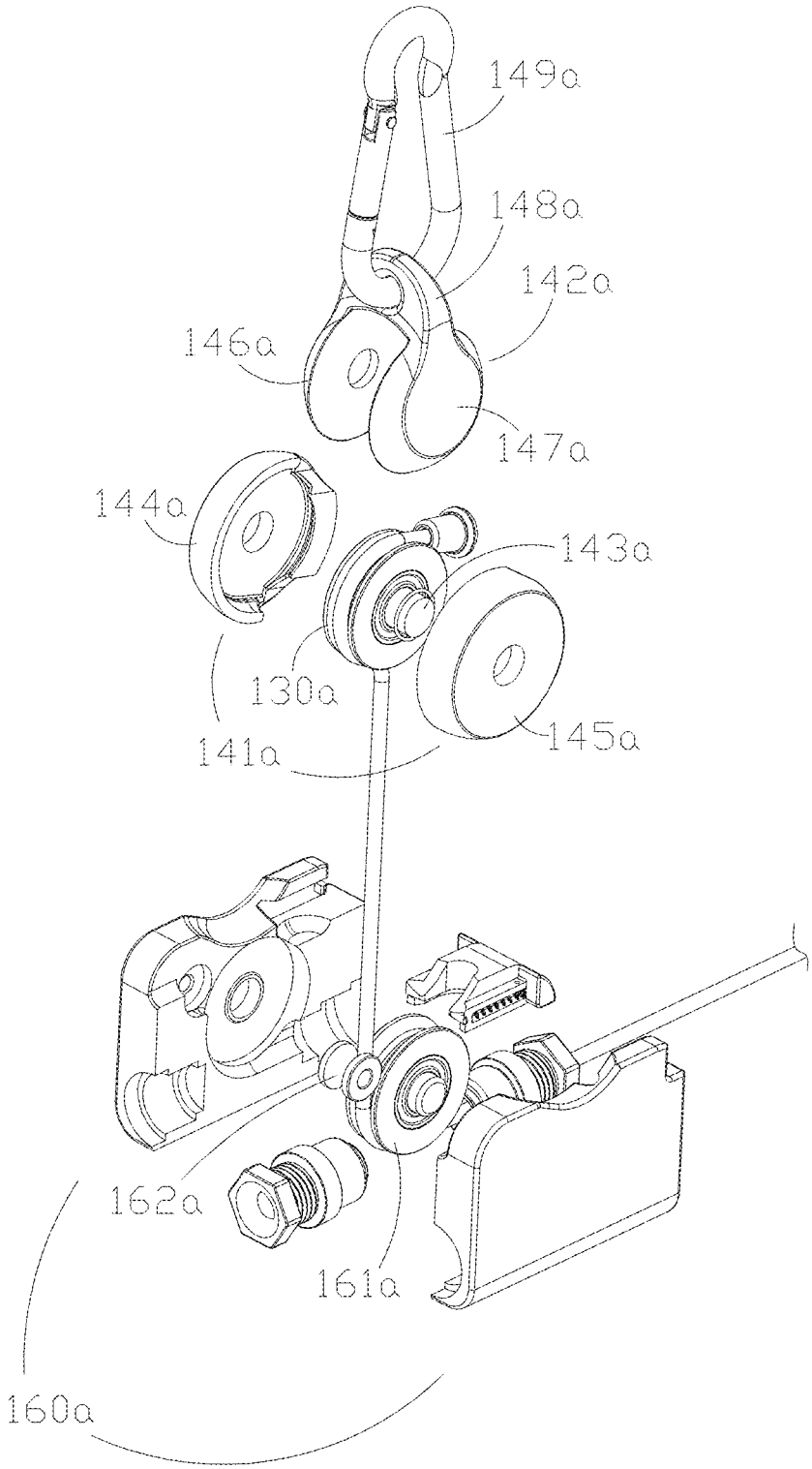
FIG. 15 is an exploded perspective view of the first embodiment of the present invention.

In one embodiment, as shown in FIG. 15, the wheel housing (140*a*) comprises a cover (141*a*), a mounting bracket (142*a*), and a rotating shaft (143*a*), wherein the rotating shaft (143*a*) is threaded through the wheel (130*a*), and both ends of the rotating shaft (143*a*) is pivotally connected to the mounting bracket (142*a*) through the cover (141*a*).

In practice, the cover (141*a*) comprises a first cover body (144*a*) and a second cover body (145*a*), wherein the first cover body (144*a*) and the second cover body (145*a*) are fastened together to form the cover (141*a*).

In practice, the mounting bracket (142*a*) comprises a first cap (146*a*), a second cap (147*a*), and a buckle (148*a*).

Wherein the first cap (146*a*) and the second cap (147*a*) are respectively positioned at both ends of the cover (141*a*).

The buckle (148*a*) is attached with a connector (149*a*) to facilitate the interconnection with the puller (40).

Figure 16:
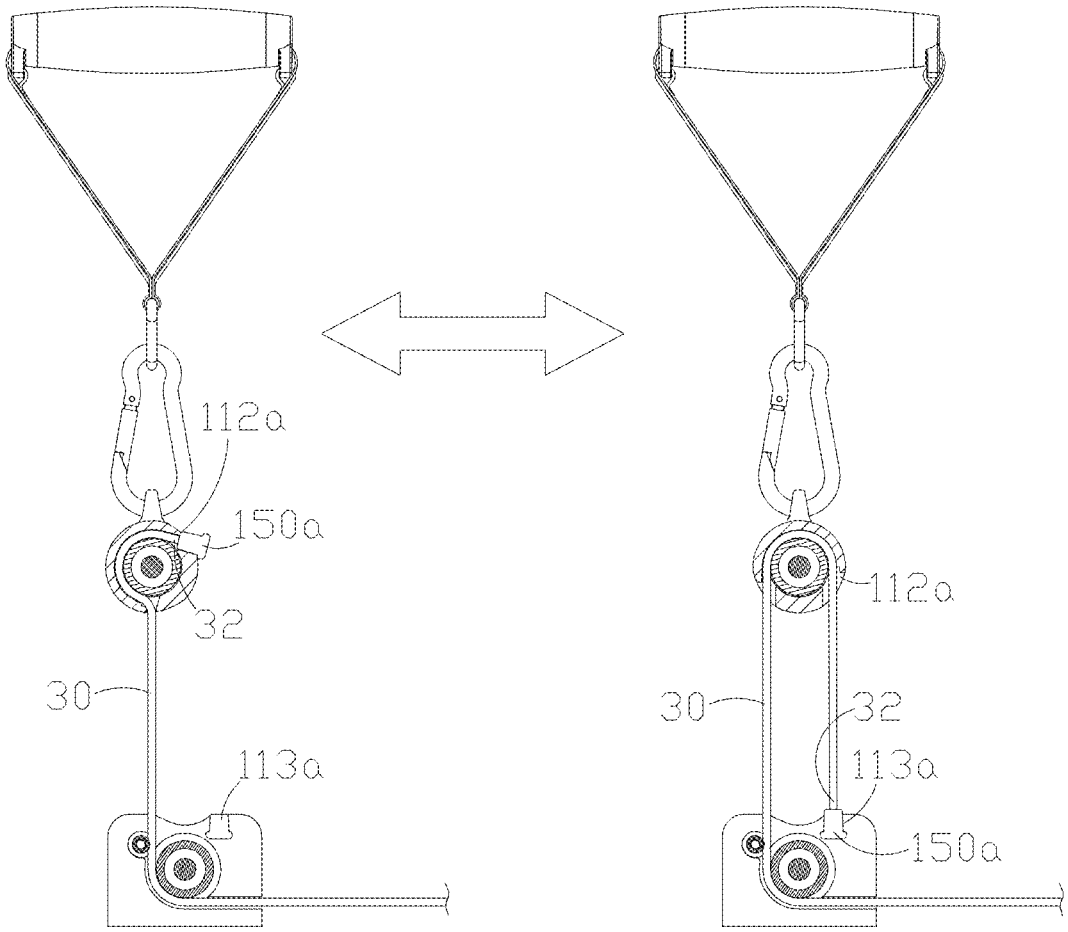
FIG. 16 is a perspective view of a working principle of a stopper of the first embodiment of the present invention.

In one embodiment, as shown in FIG. 16, the connecting end (32) of the traction rope (30) is provided with a stopper (150*a*), wherein the stopper (150*a*) allows the connecting end (32) to be fixedly connected either to the position of the fixed rope hole (112*a*) or to the connecting end fixture (113*a*), thus facilitating the switching between the direct tension transmission manner and the doubled tension transmission manner.

Figure 17:
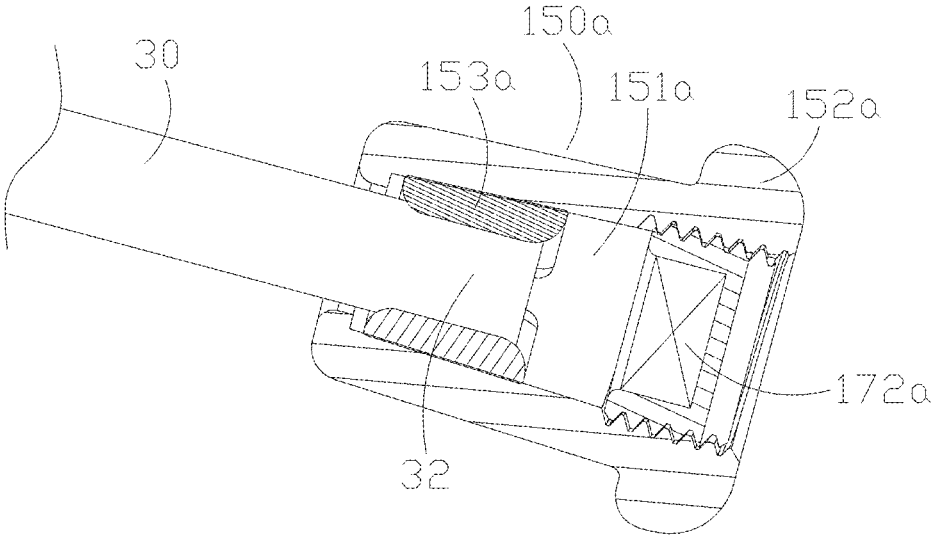
FIG. 17 is a perspective view of a stopper of the first embodiment of the present invention.

As shown in FIG. 17, in practice, the stopper (150*a*) comprises a securing portion (151*a*) and a clamping portion (152*a*), wherein the securing portion (151*a*) is used to secure the connecting end (32).

The clamping portion (152*a*) is used to secure the connecting end (32) either to the position of the fixed rope hole (112*a*) or to the connecting end fixture (113*a*).

In practice, the securing portion (151*a*) is the internal cavity of the stopper (150*a*), and the connecting end (32) is secured in the internal cavity of the stopper (150*a*).

The connecting end (32) is able to be set at a retaining ring (153*a*) for ease of fixation.

In practice, the clamping portion (152*a*) comprises a tube and a clamping ring, wherein the clamping ring is protruded at one end of the tube.

In one embodiment, as shown in FIG. 15, the converter (100*a*) also comprises a traction rope guide (160*a*).

The traction rope (30) is threaded through the traction rope guide (160*a*), wherein the traction rope guide (160*a*) is able to change the transmission direction of the tension force of the traction rope (30).

The traction rope guide (160*a*) is provided with a fixed pulley system, and the traction rope (30) is threaded through the fixed pulley system.

In practice, the traction rope guide (160*a*) is pivotally connected to the main body (10).

The fixed pulley system comprises a main fixed pulley (161*a*) and a secondary fixed pulley (162*a*), and the traction rope (30) is threaded in between of the main fixed pulley (161*a*) and the secondary fixed pulley (162*a*).

The structure as described above is able to change the trajectory of the traction rope (30) during training, thus facilitating the convenience of the users.

In one embodiment, various embodiments of the connecting end fixture (113*a*) are employed to achieve the functionality thereof, wherein one preferred embodiment are described as below.

Figure 18:
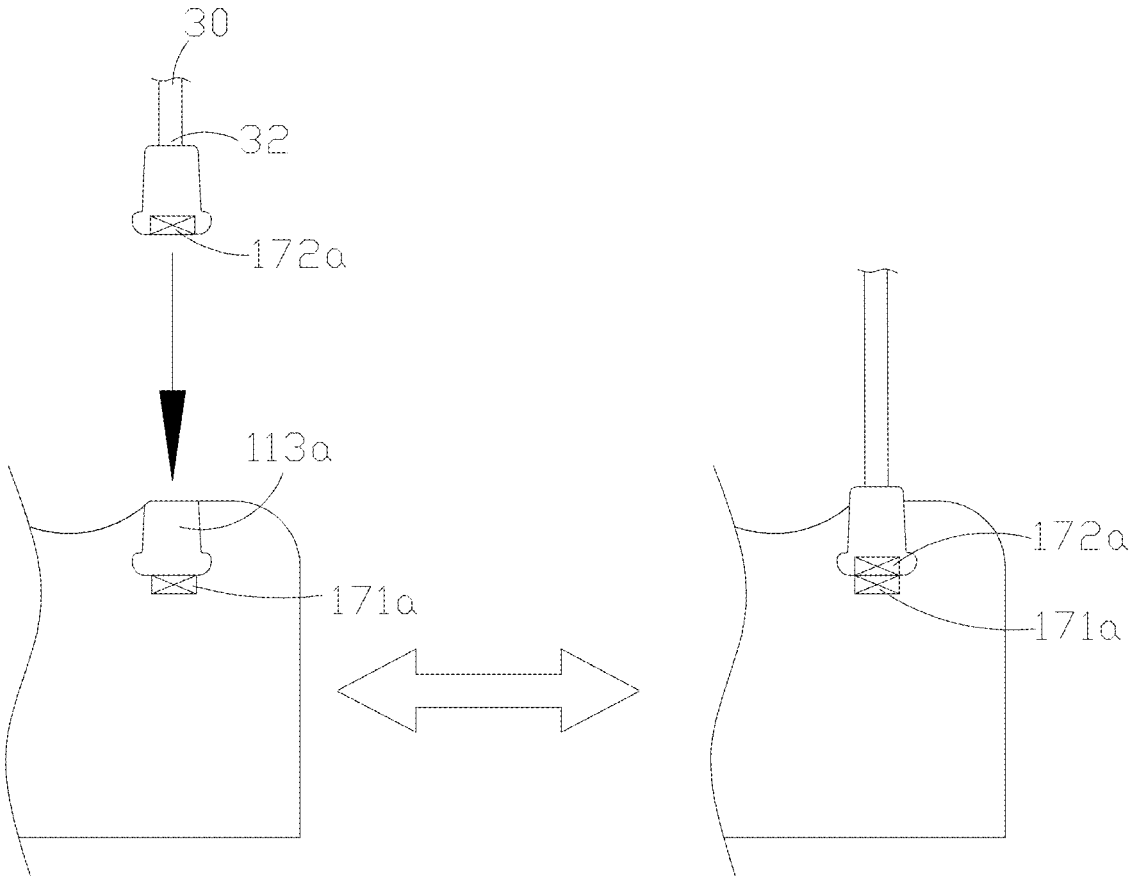
FIG. 18 is a perspective view of a mutual detection between a primary sensor and a secondary sensor of the first embodiment of the present invention.

As shown in FIG. 18, the connecting end fixture (113*a*) is provided with a primary sensor (171*a*), and corresponding to the primary sensor (171*a*), the connecting end (32) of the traction rope (30) is provided with a secondary sensor (172*a*).

While operating under the doubled tension transmission manner, when the connecting end (32) is fixed to the connecting end fixture (113*a*), the primary sensor (171*a*) and the secondary sensor (172*a*) mutually detect each other, thus generating a sensing signal.

While operating under the direct tension transmission manner, the primary sensor (171*a*) and the secondary sensor (172*a*) will not generate the sensing signal.

In practice, the sensing signal is able to be transmitted to the users in the form of sound, images, or other forms, thus allowing the users to be informed of the operating status of the resistance training system. In practice, the sensing signal can be an alert sound or an alert icon displayed on the monitor of the resistance training system, among others.

In practice, the primary sensor (171*a*) can be a magnetic sensor, and the secondary sensor (172*a*) can be a magnetic block.

Figure 19:
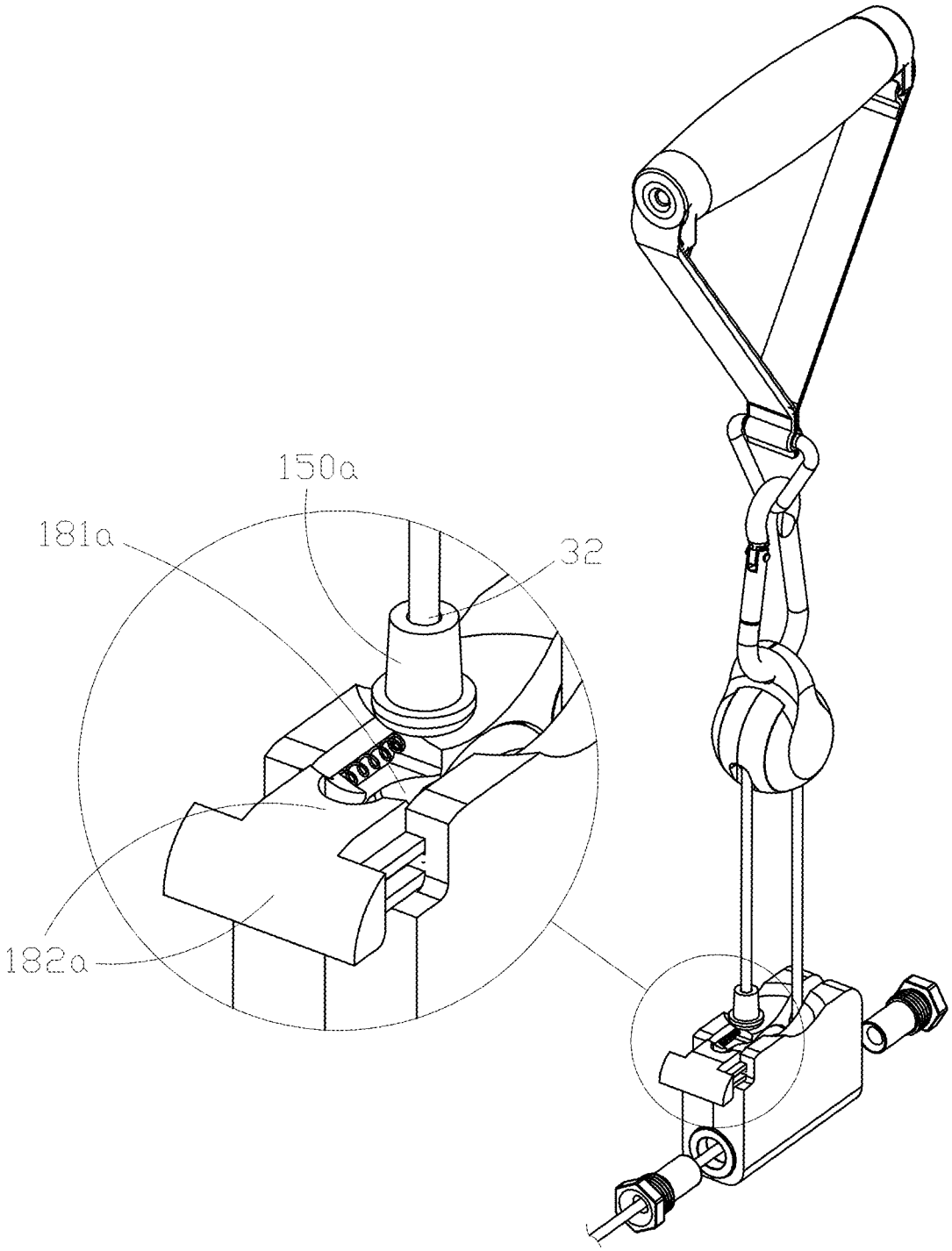
FIG. 19 is a perspective view of a stopper inserted to a mounting hole of the first embodiment of the present invention.
Figure 20:
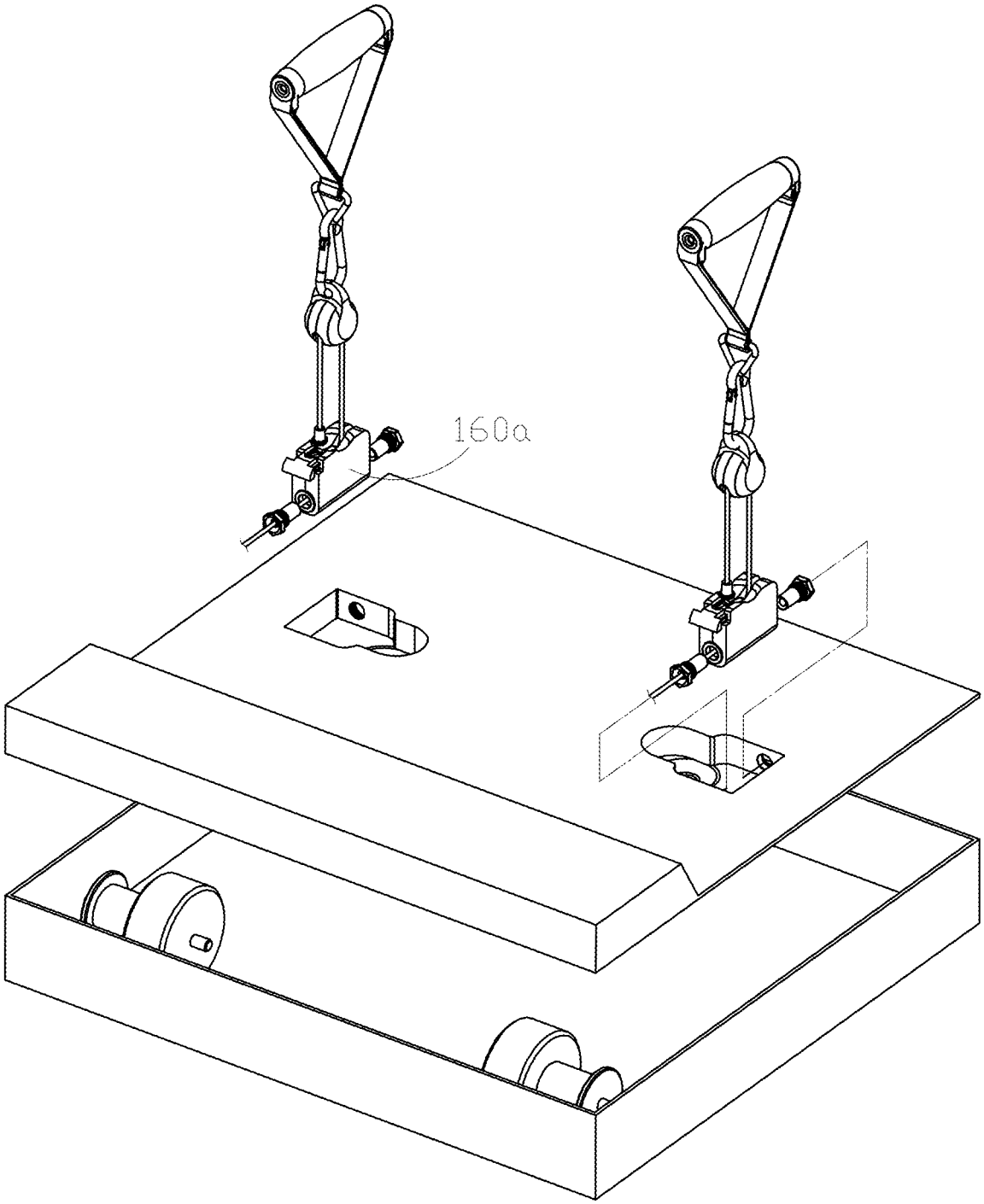
FIG. 20 is a perspective view of a traction rope guide of the first embodiment of the present invention.

In one embodiment, as shown in FIG. 19, the connecting end fixture (113*a*) comprises a mounting hole (181*a*) and a clamp cover (182*a*), and corresponding to the mounting hole (181*a*), a stopper (150*a*) is provided at the connecting end (32).

As shown in FIG. 13, while operating under the doubled tension transmission manner, the stopper (150*a*) is inserted in the mounting hole (181*a*), and the clamp cover (182*a*) is fixedly connected to the stopper (150*a*), thus securing the stopper (150*a*) in the mounting hole (181*a*).

As shown in FIG. 12, while operating under the direct tension transmission manner, the clamp cover (182*a*) is opened, and the stopper (150*a*) is removed from the mounting hole (181*a*). The stopper (150*a*) is fixedly connected to the position of the fixed rope hole (112*a*) of the converter (100*a*).

As shown in FIGS. 17 to 18, in one embodiment, the primary sensor (171*a*) is provided in the mounting hole (181*a*), and the secondary sensor (172*a*) is provided in the stopper (150*a*).

In one embodiment, as shown in FIG. 19, the connecting end fixture (113*a*) is provided at the traction rope guide (160*a*), and the clamp cover (182*a*) is a push-pull type clamp cover.

Figure 21:
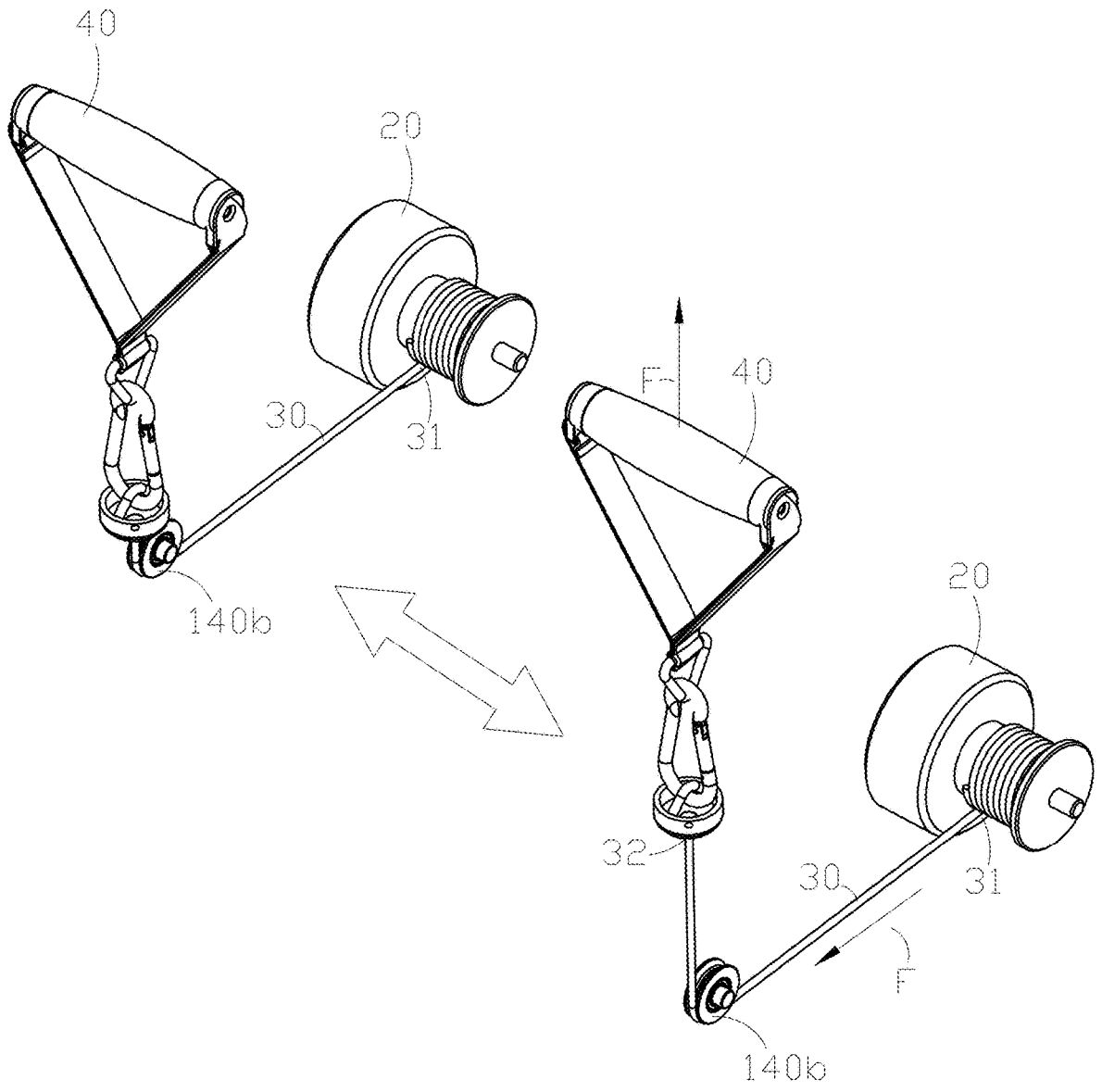
FIG. 21 is a perspective view of a converter operating under a direct tension transmission manner of the second embodiment of the present invention.

As shown in FIGS. 21 to 25, the second preferred embodiment, as shown in FIG. 21, the converter (100*b*) comprises a double-force pulley (110*b*).

While operating under the direct tension transmission manner, the puller (40) is connected to the connecting end (32) of the traction rope (30), and the tension force (F) generated by the resistance motor (20) is transmitted through the traction rope (30) to the puller (40).

Figure 22:
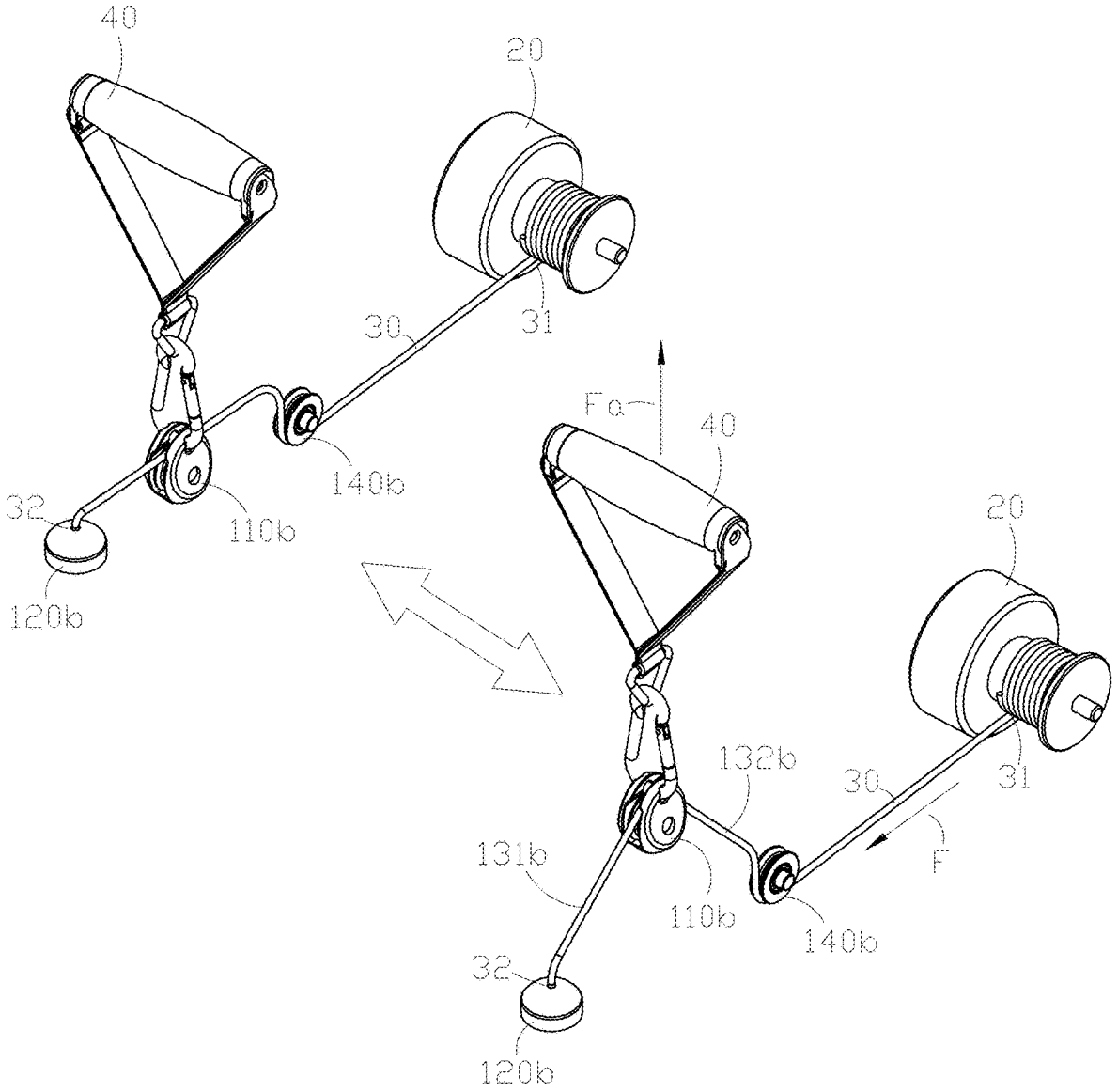
FIG. 22 is a perspective view of a converter operating under a doubled tension transmission manner of the second embodiment of the present invention.

As shown in FIG. 22, while operating under the doubled tension transmission manner, the puller (40) is connected to the double-force pulley (110*b*), wherein the double-force pulley (110*b*) is provided in between of the winding end (31) of the traction rope (30) and the connecting end (32) of the traction rope (30), wherein the connecting end (32) is fixedly connected to a fixture (120*b*).

The traction rope (30) forms a primary tension portion (131*b*) in between of the double-force pulley (110*b*) and the fixture (120*b*).

The traction rope (30) forms a secondary tension portion (132*b*) in between of the double-force pulley (110*b*) and the winding end (31).

The tension force (F) generated by the resistance motor (20) is transmitted to the traction rope (30), and the double-force pulley (110*b*) transforms the tension force (F) to a doubled tension force (Fa), wherein the doubled tension force (Fa) is transmitted through the double-force pulley (110*b*) to the puller (40).

As described above, in practice, the double-force pulley (110*b*) can be a movable pulley.

For a better understanding, an example is provided as below. For instance, suppose that the resistance motor (20) generates the tension force (F) of less than 60 kilograms, while operating under the direct tension transmission manner, the tension force (F) of less than 60 kilograms is directly transmitted to the puller (40) in order to satisfy the requirements of the second manner of training with light weights at a fast pace as described in the background of the present invention.

While operating under the doubled tension transmission manner, the double-force pulley (110*b*) transforms the tension force (F) to the doubled tension force (Fa), wherein the doubled-tension force (Fa) is transmitted to the puller (40). At this moment, when the tension force (F) is 60 kilograms, the doubled tension force (Fa) is 120 kilograms instead, thus able to satisfy the requirements of the first manner of training with heavy weights as a slow pace as described in the background of the present invention.

In addition, the connecting end (32) of the traction rope (30) can be actively connected to either the puller (40) or the fixture (120*b*) using methods such as binding or winding, among others, thus facilitating the switching between the direct tension transmission manner and the doubled tension transmission manner.

In one embodiment, the fixture (120*b*) is provided at the main body (10).

In one embodiment, the main body (10) is provided with a fixed pulley (140*b*), and the traction rope (30) is wound around the fixed pulley (140*b*), wherein the fixed pulley (140*b*) is able to alter the trajectory of the traction rope (30), thereby optimizing the transmission path of the tension force (F).

In one embodiment, the converter (100*b*) also comprises a direct tension buckle (150*b*).

Figure 23:
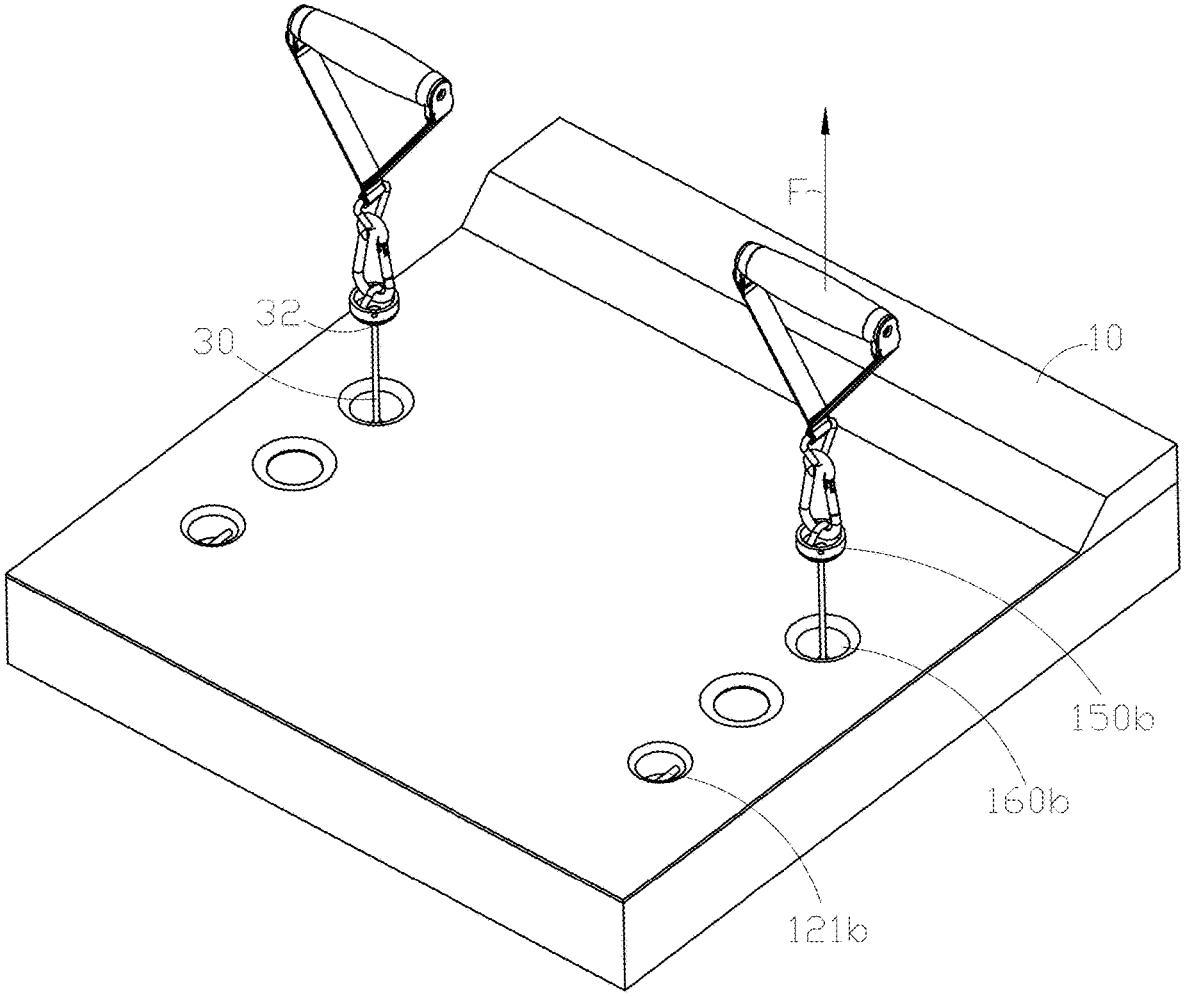
FIG. 23 is a three-dimensional perspective view of an operation of a direct tension transmission manner of the second embodiment of the present invention.

As shown in FIG. 23, while operating under the direct tension transmission manner, the puller (40) is connected to the direct tension buckle (150*b*), and the connecting end (32) of the traction rope (30) is connected to the direct tension buckle (150*b*).

The tension force (F) generated by the resistance motor (20) is directly transmitted through the traction rope (30) and the direct tension buckle (150*b*) to the puller (40).

Figure 24:
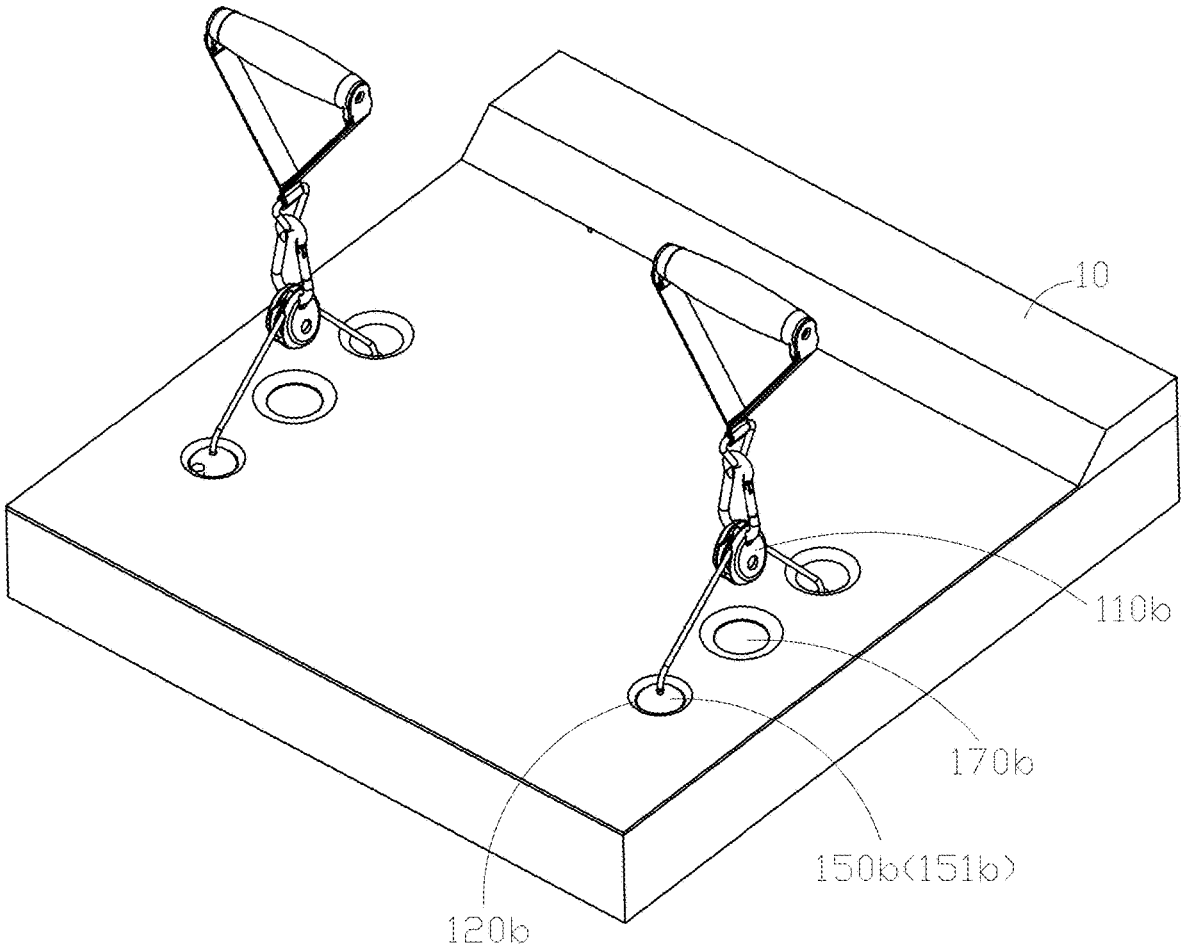
FIG. 24 is a three-dimensional perspective view of an operation of a doubled tension transmission manner of the second embodiment of the present invention.
Figure 25:
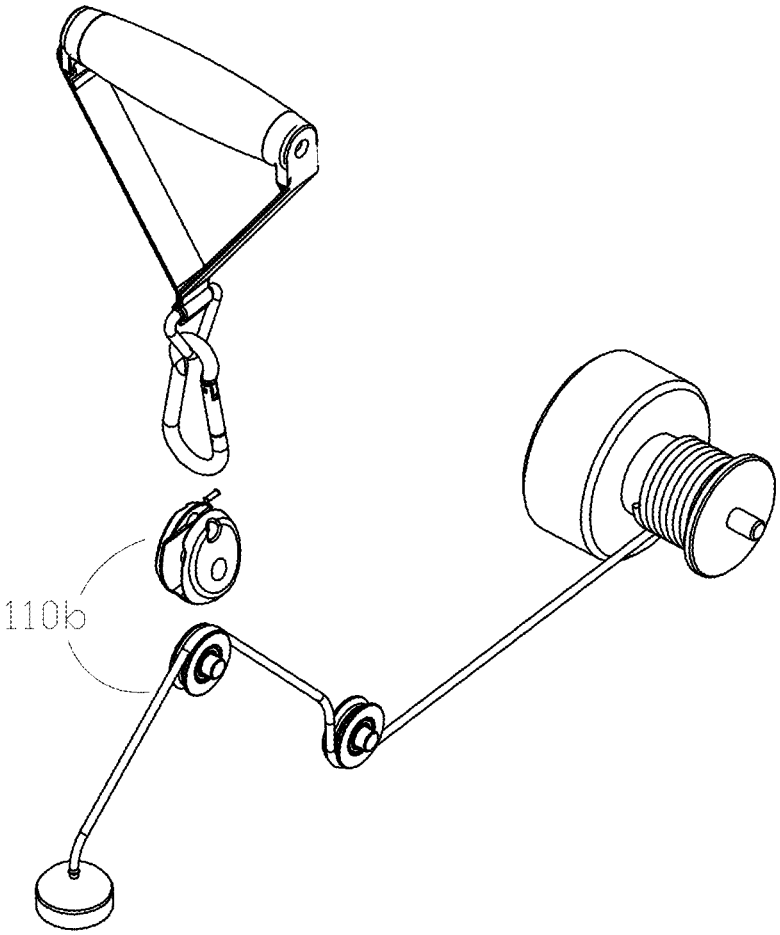
FIG. 25 is an exploded perspective view of a doubled-force pulley of the second embodiment of the present invention.

As shown in FIG. 24, the direct tension buckle (150*b*) is a tension force fastener (151*b*), such as a hook.

The fixture (120*b*) is provided at the main body (10), wherein the fixture (120*b*) is provided with a fixture fastener (121*b*), such as a hook or a rod.

The tension force fastener (151*b*) and the fixture fastener (121*b*) correspond to each other.

While operating under the doubled tension transmission manner, the tension force fastener (151*b*) is connected to the fixture fastener (121*b*).

In one embodiment, as shown in FIG. 23, the main body (10) is provided with a rope positioning hole (160*b*), and the connecting end (32) of the traction rope (30) is threaded out from the rope positioning hole (160*b*).

The direct tension buckle (150*b*) is able to be secured at the rope positioning hole (160*b*) to limit the movement of the direct tension buckle (150*b*), as well as preventing the connecting end (32) from retracting to the main body (10).

In one embodiment, the fixture (120*b*) is a mounting hole, and the fixture fastener (121*b*) is provided in the mounting hole. While operating under the doubled tension transmission manner, the tension force fastener (151*b*) is connected to the fixture fastener (121*b*), and the tension force fastener (151*b*) is positioned in the mounting hole.

In one embodiment, the main body (10) is provided with a movable pulley groove (170*b*), wherein the movable pulley groove (170*b*) is used to accommodate the double-force pulley (110*b*) to facilitate the ease of use.

What is claimed is:

1. A resistance training system, comprising a main body (10), a resistance motor (20), and a traction rope (30), wherein said traction rope (30) has a winding end (31) and a connecting end (32), wherein said winding end (31) is wound around a rotating output shaft of said resistance motor (20), wherein said connecting end (32) is actively connected to a converter (100), wherein said converter (100) and a puller (40) are interconnected to each other, and said resistance motor (20) is able to generate a tension force (F), wherein said tension force (F) is transmitted through said traction rope (30) and said converter (100) to said puller (40), said converter (100) has a direct tension transmission manner and a doubled tension transmission manner, wherein while operating under said direct tension transmission manner, said converter (100) is able to directly transmit said tension force (F) to said puller (40), wherein while operating under said doubled tension transmission manner, said converter (100) is able to convert said tension force (F) to a doubled tension force (Fa), wherein said doubled tension force (Fa) is subsequently transmitted to said puller (40), said converter (100) is able to switch between said direct tension transmission manner and said doubled tension transmission manner, wherein said converter (100*a*) comprising a traction rope channel (110*a*), a free rope hole (111*a*), a fixed rope hole (112*a*), and a connecting end fixture (113*a*), wherein said free rope hole (111*a*) and said fixed rope hole (112*a*) are respectively positioned at both ends of said traction rope channel (110*a*), and said traction rope (30) is simultaneously threaded through said traction rope channel (110*a*), said free rope hole (111*a*), and said fixed rope hole (112*a*), wherein while operating under said direct tension transmission manner, said puller (40) is connected to said converter (100*a*), and said connecting end (32) of said traction rope (30) is fixed at the position of said fixed rope hole (112*a*), wherein while operating under said doubled tension transmission manner, said puller (40) is connected to said converter (100*a*), said connecting end (32) of said traction rope (30) is fixed to said connecting end fixture (113*a*), and said converter (100*a*) is positioned in between of said winding end (31) of said traction rope (30) and said connecting end (32) of said traction rope (30), said traction rope (30) forms a primary tension portion (121*a*) in between of said fixed rope hole (112*a*) and said connecting end fixture (113*a*), and said traction rope (30) forms a secondary tension portion (122*a*) in between of said converter (100*a*) and said winding end (31).

2. The resistance training system recited in claim 1, wherein while operating under said direct tension transmission manner, said tension force (F) generated by said resistance motor (20) is directly transmitted through said traction rope (30) and said converter (100*a*) to said puller (40), wherein a training force (Fc) generated on said puller (40) is equal to said tension force (F) generated by said resistance motor (20), and while operating under said doubled tension transmission manner, said tension force (F) generated by said resistance motor (20) is transmitted to said traction rope (30), and said converter (100*a*) transforms said tension force (F) to said double tension force (Fa), wherein said double tension force (Fa) is transmitted through said converter (100*a*) to said puller (40), and said training force (Fc) generated on said puller (40) is equal to said double tension force (Fa), wherein said training force (Fc) generated on said puller (40) is two times of said tension force (F) generated by said resistance motor (20), and by fixing said connecting end (32) at said position of said fixed rope hole (112*a*) or at said connecting end fixture (113*a*), said switching between said direct tension transmission manner and said doubled tension transmission manner can be achieved.

3. The resistance training system recited in claim 1, wherein said converter (100*a*) comprising a wheel (130*a*) and a wheel housing (140*a*), wherein said wheel (130*a*) is rotatably set in said wheel housing (140*a*), wherein said traction rope channel (110*a*) is in between of said wheel (130*a*) and said wheel housing (140*a*), wherein said free rope hole (111*a*) and said fixed rope hole (112*a*) is set on said wheel housing (140*a*), wherein said free rope hole (111*a*) and said fixed rope hole (112*a*) are respectively interconnected with said traction rope channel (110*a*).

4. The resistance training system recited in claim 3, wherein said wheel housing (140*a*) comprising a cover (141*a*), a mounting bracket (142*a*), and a rotating shaft (143*a*), wherein said rotating shaft (143*a*) is threaded through said wheel (130*a*), and both ends of said rotating shaft (143*a*) is pivotally connected to said mounting bracket (142*a*) through said cover (141*a*).

5. The resistance training system recited in claim 4, wherein said cover (141*a*) comprising a first cover body (144*a*) and a second cover body (145*a*), wherein said first cover body (144*a*) and said second cover body (145*a*) are fastened together to form said cover (141*a*), and said mounting bracket (142*a*) comprising a first cap (146*a*), a second cap (147*a*), and a buckle (148*a*), wherein said first cap (146*a*) and said second cap (147*a*) are respectively positioned at both ends of said cover (141*a*), and said buckle (148*a*) is attached with a connector (149*a*).

6. The resistance training system recited in claim 1, wherein said connecting end (32) of said traction rope (30) is provided with a stopper (150*a*), wherein said stopper (150*a*) allows said connecting end (32) to be fixedly connected either to said position of said fixed rope hole (112*a*) or to said connecting end fixture (113*a*).

7. The resistance training system recited in claim 6, wherein said stopper (150*a*) comprises a securing portion (151*a*) and a clamping portion (152*a*), wherein said securing portion (151*a*) is used to secure said connecting end (32), and said clamping portion (152*a*) is used to secure said connecting end (32) either to said position of said fixed rope hole (112*a*) or to said connecting end fixture (113*a*).

8. The resistance training system recited in claim 7, wherein said securing portion (151*a*) is an internal cavity of said stopper (150*a*), and said connecting end (32) is secured in said internal cavity of said stopper (150*a*), and said clamping portion (152*a*) comprising a tube and a clamping ring, wherein said clamping ring is protruded at one end of said tube.

9. The resistance training system recited in claim 1, wherein said converter (100*a*) also comprising a traction rope guide (160*a*), wherein said traction rope (30) is threaded through said traction rope guide (160*a*), wherein said traction rope guide (160*a*) is able to change the transmission direction of said tension force of said traction rope (30), wherein said traction rope guide (160*a*) is provided with a fixed pulley system, and said traction rope (30) is threaded through said fixed pulley system.

10. The resistance training system recited in claim 9, wherein said traction rope guide (160*a*) is pivotally connected to said main body (10).

11. The resistance training system recited in claim 9, wherein said fixed pulley system comprising a main fixed pulley (161*a*) and a secondary fixed pulley (162*a*), and said traction rope (30) is threaded in between of said main fixed pulley (161*a*) and said secondary fixed pulley (162*a*).

12. The resistance training system recited in claim 1, wherein said connecting end fixture (113*a*) is provided with a primary sensor (171*a*), and corresponding to said primary sensor (171*a*), said connecting end (32) of said traction rope (30) is provided with a secondary sensor (172*a*), and while operating under said doubled tension transmission manner, when said connecting end (32) is fixed to said connecting end fixture (113*a*), said primary sensor (171*a*) and said secondary sensor (172*a*) mutually detect each other, thus generating a sensing signal.

13. The resistance training system recited in claim 12, wherein said primary sensor (171*a*) is a magnetic sensor, and said secondary sensor (172*a*) is a magnetic block.

14. The resistance training system recited in claim 1, wherein said connecting end fixture (113*a*) comprising a mounting hole (181*a*) and a clamp cover (182*a*), and corresponding to said mounting hole (181*a*), a stopper (150*a*) is provided at said connecting end (32), and while operating under said doubled tension transmission manner, said stopper (150*a*) is inserted in said mounting hole (181*a*), and said clamp cover (182*a*) is fixedly connected to said stopper (150*a*), thus securing said stopper (150*a*) in said mounting hole (181*a*), and while operating under said direct tension transmission manner, said clamp cover (182*a*) is opened, and said stopper (150*a*) is removed from said mounting hole (181*a*), and said stopper (150*a*) is fixedly connected to said position of said fixed rope hole (112*a*) of said converter (100*a*).

15. The resistance training system recited in claim 1, wherein said connecting end fixture (113*a*) is provided with a primary sensor (171*a*), and corresponding to said primary sensor (171*a*), said connecting end (32) of said traction rope (30) is provided with a secondary sensor (172*a*), and while operating under said doubled tension transmission manner, when said connecting end (32) is fixed to said connecting end fixture (113*a*), said primary sensor (171*a*) and said secondary sensor (172*a*) mutually detect each other, thus generating a sensing signal, wherein said connecting end fixture (113*a*) comprising a mounting hole (181*a*) and a clamp cover (182*a*), and corresponding to said mounting hole (181*a*), a stopper (150*a*) is provided at said connecting end (32), and while operating under said doubled tension transmission manner, said stopper (150*a*) is inserted in said mounting hole (181*a*), and said clamp cover (182*a*) is fixedly connected to said stopper (150*a*), thus securing said stopper (150*a*) in said mounting hole (181*a*), and while operating under said direct tension transmission manner, said clamp cover (182*a*) is opened, and said stopper (150*a*) is removed from said mounting hole (181*a*), and said stopper (150*a*) is fixedly connected to said position of said fixed rope hole (112*a*) of said converter (100*a*), wherein said primary sensor (171*a*) is provided in said mounting hole (181*a*), and said secondary sensor (172*a*) is provided in said stopper (150*a*), wherein said connecting end fixture (113*a*) is provided at said traction rope guide (160*a*).

* * * * *